US010301126B2

(12) United States Patent
Nakada

(10) Patent No.: US 10,301,126 B2
(45) Date of Patent: May 28, 2019

(54) MEDIUM-SUCTION APPARATUS, IMAGE FORMING SYSTEM, AND MEDIUM INSPECTION SYSTEM

(71) Applicant: Kyosuke Nakada, Kanagawa (JP)

(72) Inventor: Kyosuke Nakada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/611,867

(22) Filed: Jun. 2, 2017

(65) Prior Publication Data

US 2017/0361628 A1 Dec. 21, 2017

(30) Foreign Application Priority Data

Jun. 20, 2016 (JP) ..... 2016-121352
Apr. 19, 2017 (JP) ..... 2017-083132

(51) Int. Cl.

*B65H 1/04* (2006.01)
*B65H 3/12* (2006.01)
*B65H 7/02* (2006.01)
*B65H 7/16* (2006.01)

(52) U.S. Cl.

CPC ..... *B65H 1/04* (2013.01); *B65H 3/128* (2013.01); *B65H 7/02* (2013.01); *B65H 7/16* (2013.01); *B65H 2406/3222* (2013.01); *B65H 2406/3632* (2013.01); *B65H 2406/3662* (2013.01); *B65H 2406/415* (2013.01); *B65H 2511/10* (2013.01); *B65H 2511/13* (2013.01); *B65H 2513/51* (2013.01); *B65H 2513/53* (2013.01); *B65H 2515/10* (2013.01)

(58) Field of Classification Search

CPC .. B65H 1/04; B65H 3/128; B65H 2406/3222; B65H 2406/3632; B41J 15/048; B41J 11/007

See application file for complete search history.

(56) References Cited

U.S. PATENT DOCUMENTS

2011/0272877 A1* 11/2011 Wardak ..... B65H 3/128 271/12
2015/0225193 A1* 8/2015 Haeussler ..... B26D 7/018 294/183

FOREIGN PATENT DOCUMENTS

JP 2014-205574 10/2014

* cited by examiner

*Primary Examiner* — Jason S Uhlenhake
(74) *Attorney, Agent, or Firm* — Cooper & Dunham LLP

(57) ABSTRACT

A medium-suction apparatus includes a conveyer to convey a medium in a conveyance direction, a first suction unit to perform suction operation on the medium to attract the medium to the conveyer, and a second suction unit to perform the suction operation on the medium to attract the medium to the conveyer. The second suction unit being disposed next to the first suction unit in a width direction perpendicular to the conveyance direction. The second suction unit starts the suction operation after the first suction unit starts the suction operation.

19 Claims, 20 Drawing Sheets

MEDIUM-SUCTION APPARATUS, IMAGE FORMING SYSTEM, AND MEDIUM INSPECTION SYSTEM

CROSS-REFERENCE TO RELATED APPLICATIONS

This patent application is based on and claims priority pursuant to 35 U.S.C. § 119(a) to Japanese Patent Application No. 2016-121352, filed on Jun. 20, 2016, and Japanese Patent Application No. 2017-083132, filed on Apr. 19, 2017, in the Japan Patent Office, the entire disclosures of which are hereby incorporated by reference herein.

BACKGROUND

Technical Field

Aspects of the present disclosure relate to a medium-suction apparatus, an image forming system, and a medium inspection system.

Related Art

An air suction type of a medium-suction apparatus is known, which suctions a medium and feeds it to a copier, an image forming system such as printer, or a medium inspection apparatus. The air suction type of the medium-suction apparatus suctions the topmost medium among a plurality of medium stacked on a stacker and conveys the suctioned medium to the copier, the image forming system, or the medium inspection apparatus, in a predetermined conveyance direction using a conveyance device while attracting the medium to the medium-suction apparatus.

SUMMARY

In an aspect of this disclosure, there is provided a novel medium-suction apparatus. The medium-suction apparatus includes a conveyer to convey a medium in a predetermined conveyance direction, a first suction unit to perform a suction operation on the medium to attract the medium to the conveyer, and a second suction unit to perform a suction operation on the medium to attract the medium to the conveyer. The second suction unit is disposed next to the first suction unit in a width direction perpendicular to the conveyance direction. The second suction unit starts the suction operation after the first suction unit starts the suction operation.

In another aspect of this disclosure, there is provided an image forming system. The image forming system includes a medium-suction apparatus to attract a medium to a conveyer to convey the medium, and an image forming unit to form an image on the medium conveyed by the medium-suction apparatus. The medium-suction apparatus includes a conveyer to convey a medium in a conveyance direction, a first suction unit to perform a suction operation on the medium to attract the medium to the conveyer, and a second suction unit to perform a suction operation on the medium to attract the medium to the conveyer. The second suction unit being disposed next to the first suction unit in a width direction perpendicular to the conveyance direction. The second suction unit starts the suction operation after the first suction unit starts the suction operation.

In still another aspect of this disclosure, there is provided a medium inspection system. The medium inspection system includes a medium-suction apparatus to attract a medium to a conveyer to convey the medium, and an inspection unit to inspect the medium conveyed by the medium-suction apparatus. The medium-suction apparatus includes a conveyer to convey a medium in a conveyance direction, a first suction unit to perform a suction operation on the medium to attract the medium to the conveyer, and a second suction unit to perform a suction operation on the medium to attract the medium to the conveyer. The second suction unit being disposed next to the first suction unit in a width direction perpendicular to the conveyance direction. The second suction unit starts the suction operation after the first suction unit starts the suction operation.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
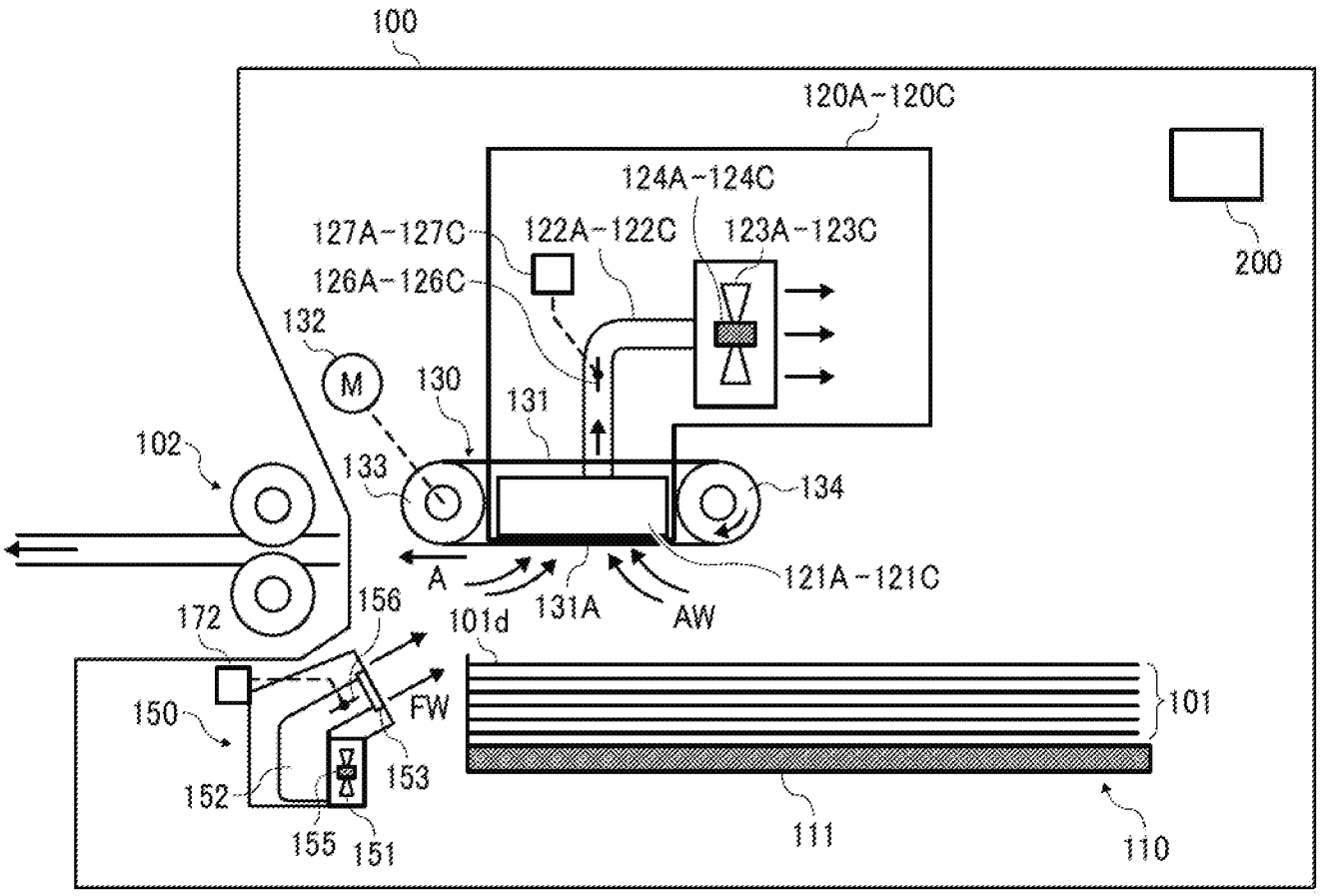
FIG. 1 is a schematic cross-sectional view of a medium-suction apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

Hereinafter, embodiments of the present disclosure are described with reference to the attached drawings. Referring now to the drawings, wherein like reference numerals designate identical or corresponding parts throughout the several views, embodiments of the present disclosure are described below.

First Embodiment

FIG. 1 is a schematic view of a medium-suction apparatus 100 according to an embodiment of the present disclosure.

The medium-suction apparatus 100 includes a stacker 110, a plurality of suction units 120A, 120B, and 120C, a conveyance device 130, a fan unit 150, a discharger 102 and a controller 200. A sheet-shaped medium 101 is stacked on the stacker 110. The fan unit 150 acts as a separator to separate a topmost medium from the medium stacked on the stacker 110.

The stacker 110 stacks a plurality of medium 101. The stacker 110 includes a lifting tray 111 including a lifting device that moves up and down in accordance with a remaining number of stacked medium 101.

The conveyance device 130 conveys the medium 101 outside the medium-suction apparatus 100 in a predetermined medium-conveyance direction (hereinafter, referred to as "conveyance direction") indicated by arrow A in FIG. 1. The discharger 102 discharges the medium 101 conveyed by the conveyance device 130 in the conveyance direction A to another device disposed outside the medium-suction apparatus 100.

The controller 200 controls the suction units 120A, 120B, and 120C, the conveyance device 130, the fan unit 150, and the discharger 102 to perform a suction operation and a conveyance operation of the medium 101. The conveyance device 130 includes a conveyance belt 131 and a belt driving motor 132. The conveyance belt 131 attracts the medium 101 with a suction force generated by the suction units 120A, 120B, and 120C and conveys the medium 101 outside the medium-suction apparatus 100 along the conveyance direction A. The belt driving motor 132 is a belt drive source to rotate the conveyance belt 131 to travel.

The conveyance belt 131 includes many small-diameter holes formed through the thickness of the conveyance belt 131. Airflow AW generated by the suction units 120A, 120B, and 120C travels through the small-diameter holes of the conveyance belt 131. The conveyance belt 131 is supported and stretched around at least two conveyance rollers 133 and 134. One of the conveyance rollers 133 and 134 is driven to rotate clockwise by the belt driving motor 132 as illustrated in FIG. 1 so that the conveyance belt 131 rotates and travels clockwise. The belt driving motor 132 drives and rotates the conveyance roller 133 to rotate the conveyance belt 131 in the present embodiment.

The conveyance device 130 suctions the topmost medium 101 upward with the suction units 120A, 120B, and 120C. Further, the conveyance device 130 attracts the topmost medium 101 to a suction face 131A of the conveyance belt 131 disposed at a position facing the topmost medium 101. The conveyance device 130 conveys the topmost medium 101 in the conveyance direction A by driving the belt driving motor 132 while attracting the topmost medium 101 to the suction face 131A of the conveyance belt 131.

As illustrated in FIG. 1, the fan unit 150 blows out airflow AW as a separation wind toward a leading end 101*d* side of the topmost medium 101 according to a timing of a suction operation performed on the topmost medium 101 with the suction units 120A, 120B, and 120C at the stacker 110. The leading end 101*d* is an end side of the topmost medium 101 and is disposed at the leading end in the conveyance direction A.

The fan unit 150 blows air FW toward the leading end 101*d* side of the topmost medium 101 to introduce airflow AW between the topmost medium 101 and the medium 101 positioned below the topmost medium 101, thereby the topmost medium 101 floats up toward the conveyance device 130

As illustrated in FIG. 1, the fan unit 150 includes a blower fan 151, a blower duct 152, and a blower nozzle 153, etc. The blower fan 151 is driven to rotate with a fan motor 155 acting as a driving part. One end of the blower duct 152 communicates with the blower fan 151. The blower nozzle 153 communicates with the other end of the blower duct 152.

The fan unit 150 draws in outside air from an opening of the blower fan 151 with the driven rotation of the blower fan 151. The fan unit 150 discharges the air as airflow FW from the blower nozzle 153 through the blower duct 152. The fan unit 150 blows air FW toward the leading end 101*d* of the topmost medium 101 and the medium 101 disposed below the topmost medium 101. The topmost medium 101 is thereby separated from the medium 101 below the topmost medium 101 and floats upward by the positive pressure of the airflow FW.

The suction units 120A, 120B, and 120C are disposed above the leading end 101*d* side of the medium 101. The suction units 120A, 120B, and 120C suction the leading end 101*d* side of the medium 101, thereby accelerating attraction of the topmost medium 101 toward the suction face 131A of the conveyance belt 131 of the conveyance device 130. The conveyance device 130 acts as a conveyer to convey the medium 101 in the conveyance direction A.

As illustrated in FIG. 1, the fan unit 150 includes an electrically operated shutter 156 that opens or closes the blower duct 152 or the blower nozzle 153. The shutter 156 is opened or closed by the fan shutter driver 172. The fan unit 150 blows out the airflow FW from the blower nozzle 153 by turning on and turning off the fan shutter driver 172 while operating the fan motor 155. The fan unit 150 may blows air FW to the leading end 101*d* side of the medium 101 while fuming on and turning off the fan motor 155.

In this case, it is not necessarily to provide the shutter 156 and the fan shutter driver 172 on the fan unit 150. If the fan unit 150 does not have the shutter 156 and the fan shutter driver 172, there is a time lag between a start of the rotation of the blower fan 151 and time of a generation of airflow sufficient to separate the medium 101. Therefore, it is preferable to adjust the timing of blowing airflow FW by opening and closing the shutter 156 using the fan shutter driver 172.

Figure 2:
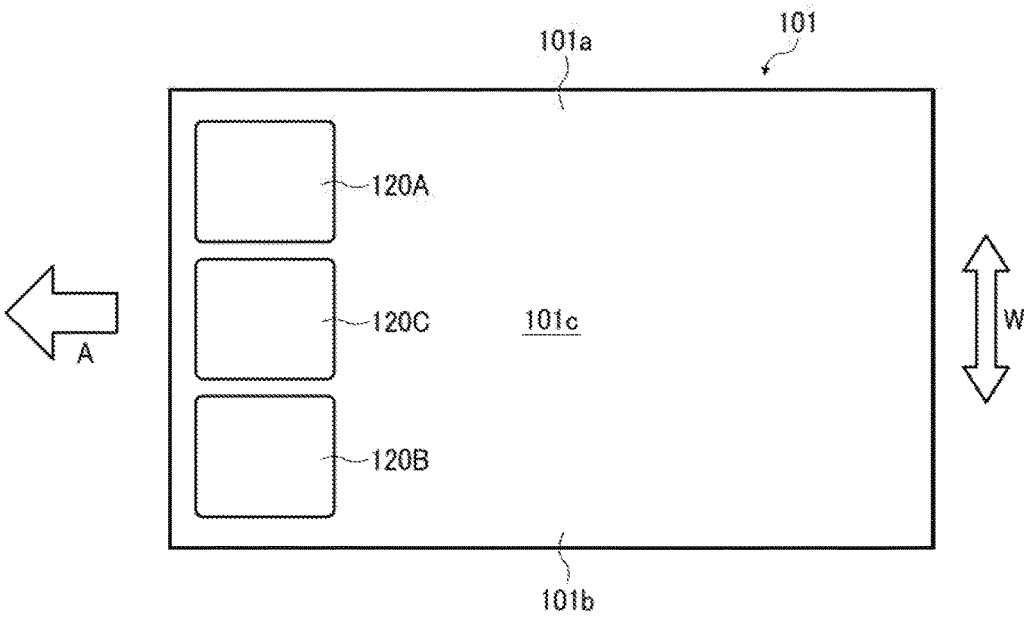
FIG. 2 is a plan view of suction units of the medium-suction apparatus according to the present embodiment.
Figure 3:
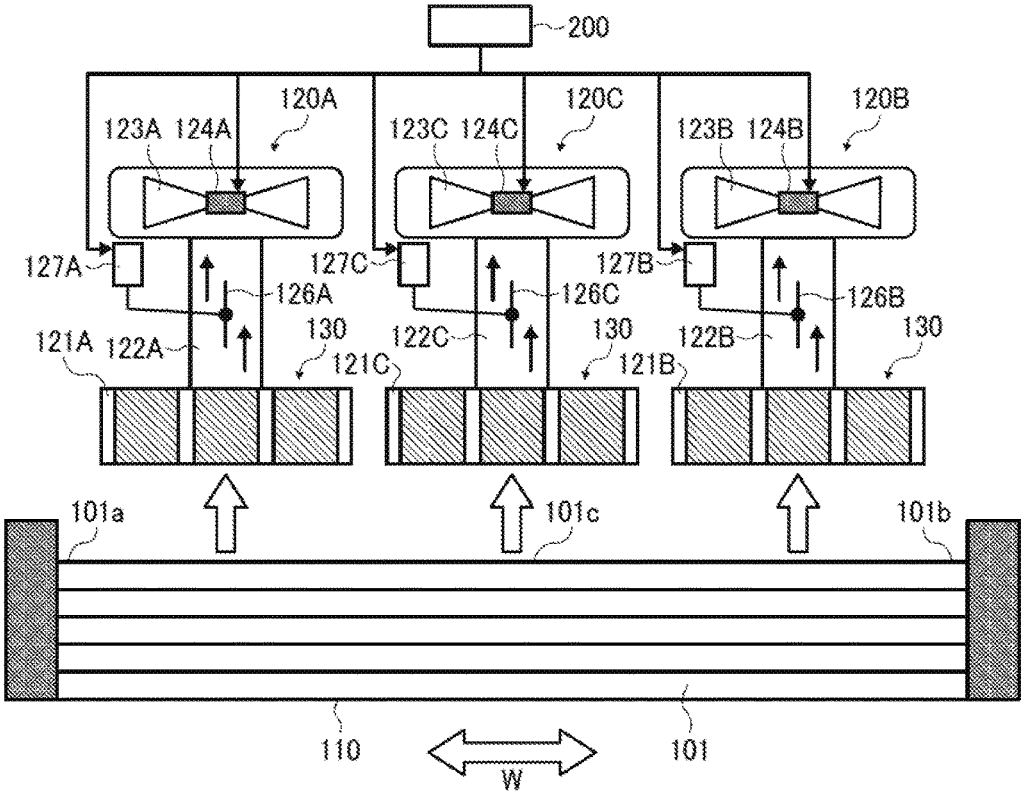
FIG. 3 is a schematic cross-sectional view of the medium-suction apparatus.

FIG. 2 is a plan view of suction units 120A, 120B, and 120C of the medium-suction apparatus according to the present embodiment. FIG. 3 is a schematic cross-sectional view of the medium-suction apparatus 100.

As illustrated in FIGS. 2 and 3, the suction units 120A, 120B, and 120C are disposed next to each other and disposed in a width direction W perpendicular to the medium conveyance direction A. The suction units 120A, 120B, and 120C are disposed above the medium 101 stacked in the stacker 110. The suction units 120A, 120B, and 120C have an identical structure. As illustrated in FIG. 3, the suction units 120A, 120B, and 120C include suction chambers 121A, 121B, and 121C, suction ducts 122A. 122B, and 122C, suction blades 123A, 123B, and 123C, and suction drivers 124A, 124B, and 124C, respectively. The suction drivers 124A, 124B, and 124C act as negative pressure generators.

The suction units 120A, 120B, and 120C drive the suction drivers 124A, 124B, and 124C, respectively, to rotate the suction blades 123A, 123B, and 123C, thereby generating negative pressure in the suction chambers 121A, 121B, and 121C. Thus, the suction units 120A, 120B, and 120C are air suction-type suction units (hereinafter referred to as "chamber type"). The suction units 120A, 120B, 120C exert a suction force on the topmost medium 101 stack on the stacker 110 with the negative pressure generated in the suction chambers 121A, 121B, and 121C. The suction blades 123A, 123B, and 123C act as negative pressure generating devices.

As illustrated in FIG. 1, the suction chambers 121A, 121B, and 121C are disposed inside the conveyance device 130. Each suction chambers 121A, 121B, and 121C includes openings at each bottoms of the suction chambers 121A, 121B, and 121C. Further, large numbers of small-diameter holes are formed in the conveyance belt 131. Thus, the bottoms of the suction chambers 121A, 121B, and 121C are communicating with space below the suction chambers 121A, 121B, and 121C and the conveyance belt 131 via the small-diameter holes in the conveyance belt 131. The suction chambers 121A, 121B, and 121C are connected to the suction blades 123A, 123B, and 123C and the suction drivers 124A, 124B, and 124C, respectively, via the suction ducts 122A, 122B, and 122C.

The suction units 120A, 120B, and 120C suction air from the area below the conveyance device 130 by rotating the suction blades 123A, 123B, and 123C with the suction drivers 124A, 124B, and 124C. The suction units 120A, 120B, and 120C exhaust the suctioned air outside the suction units 120A, 120B, and 120C through the suction chambers 121A, 121B, and 121C, the suction ducts 122A, 122B, and 122C, and the suction blades 123A, 123B, and 123C by rotating the suction blades 123A, 123B, and 123C with the suction drivers 124A, 124B, and 124C. Thus, air is communicated through each of the suction chambers 121A, 121B, and 121C.

As a negative pressure generator, a compressor may be used instead of a combination of the suction blades 123A, 123B, and 123C and the suction drivers 124A, 124B, and 124C.

The suction units 120A, 120B, and 120C includes an electrically-operated shutter 126A, 126B, and 126C acting as a control valve to open or close the suction ducts 122A, 122B, and 122C or the suction chambers 121A, 121B, and 121C to control negative pressure. The shutters 126A, 126B, and 126C are disposed inside the suction ducts 122A, 122B, and 122C. The shutter drivers 127A, 127B, and 127C operate to open or close the shutters 126A, 126B, and 126C, respectively. A suction force generated by the airflow AW is applied on the medium 101 by opening the shutters 126A, 126B, and 126C while rotating the suction blades 123A, 123B, and 123C by the suction drivers 124A, 124B, and 124C.

In the present embodiment, the shutters 126A, 126B, and 126C can change a cross-sectional area of openings inside the suction ducts 122A, 122B, and 122C. The shutters 126A, 126B, and 126C are disposed inside the suction ducts 122A, 122B, and 122C, respectively. The suction ducts 122A, 122B, and 122C connect the suction chambers 121A, 121B, and 121C with the suction blades 123A, 123B, and 123C, respectively. Pressure inside the suction chambers 121A, 121B, and 121C can be adjusted by adjusting the shutter 126A, 126B, and 126C even when the suction drivers 124A, 124B, and 124C are constantly operated. That is, the shutter 126A, 126B, and 126C function as a control valve to open or close the suction ducts 122A, 122B, and 122C to adjust the negative pressure inside the suction chambers 121A, 121B, and 121C.

The suction units 120A, 120B, and 120C may exert the suction force on the medium 101 by turning on and off the suction drivers 124A, 124B, and 124C without providing the shutters 126A, 126B, and 126C and the shutter drivers 127A, 127B, and 127C on the suction units 120A, 120B, and 120C. In this case, there is a time lag between starts of the rotations of the suction blades 123A, 123B, and 123C and generating the suction force (negative pressure) applied on the medium 101. Therefore, it is preferable to adjust the timing of applying the suction force on the medium 101 by opening and closing the shutters 126A, 126B, and 126C by the shutter drivers 127A, 127B, and 127C while constantly driving the suction drivers 124A, 124B, and 124C to achieve high-speed operation.

Figure 4:
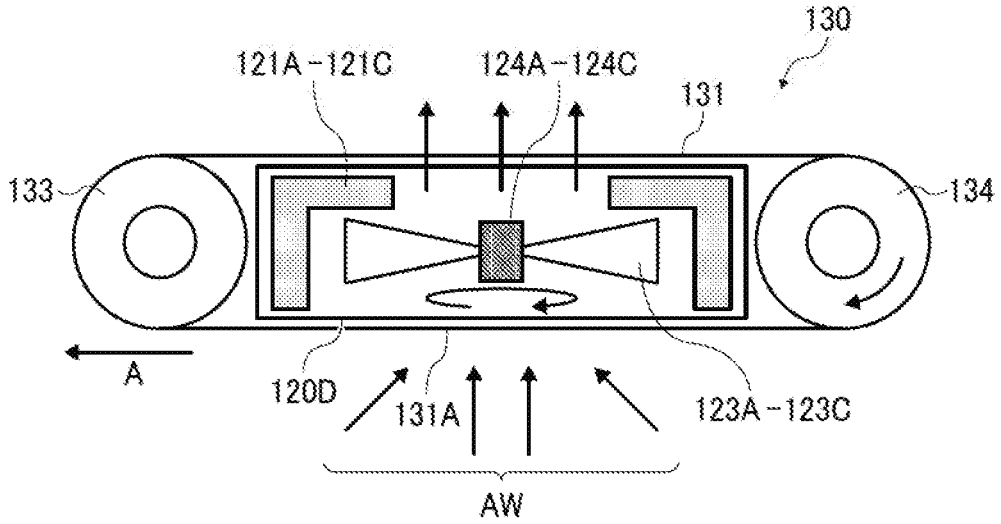
FIG. 4 is a cross-sectional view of a medium-suction apparatus according to another embodiment.

FIG. 4 is a cross-sectional view of a medium-suction apparatus according to another embodiment.

The configuration of the suction units 120A, 120B, and 120C is not limited to FIG. 1 and may have other configurations. For example, the suction unit 120D illustrated in FIG. 4 does not include the suction ducts 122A, 122B, and 122C compared to the suction units 120A, 120B, and 120C as illustrated in FIG. 1. As illustrated in FIG. 4, the suction unit 120D drives the suction drivers 124A, 124B, and 124C to rotate the suction blades 123A, 123B, and 123C to suck air from the area below the suction blades 123A, 123B, and 123C and exhausts the sucked air above the suction unit 120D. The suction unit 120D generates negative pressure in the suction chambers 121A, 121B, and 121C to attract the medium 101 to the suction face 131A of the conveyance belt 131.

Figure 5A:
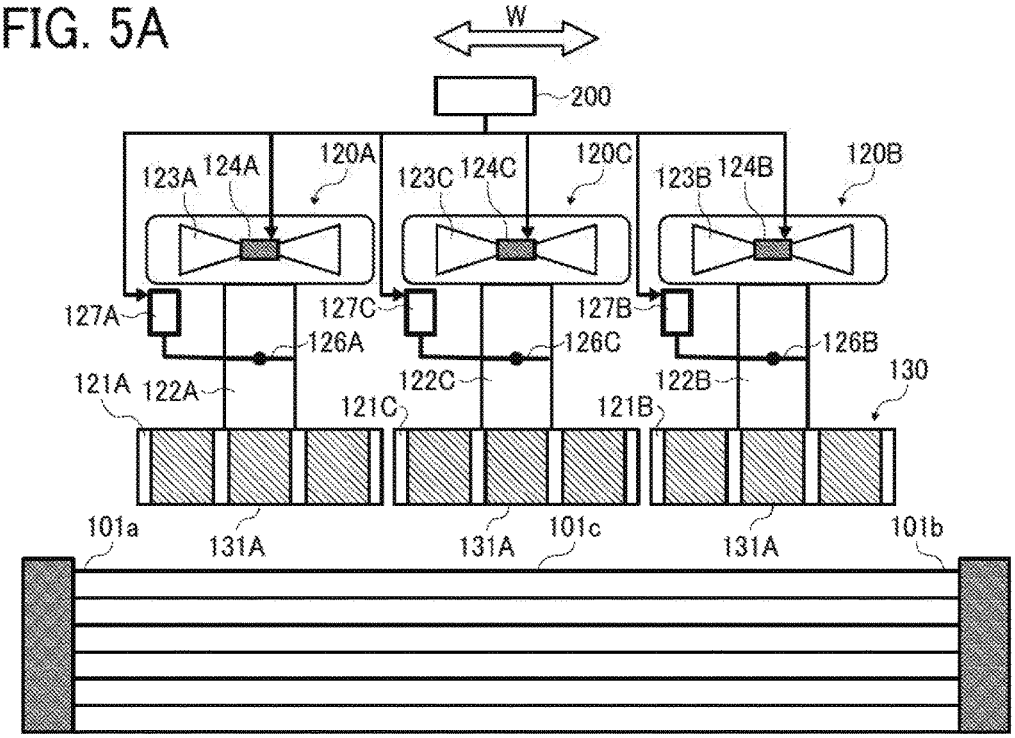
FIGS. 5A to 5C are cross-sectional views of an example of a medium-suction apparatus.
Figure 5B:
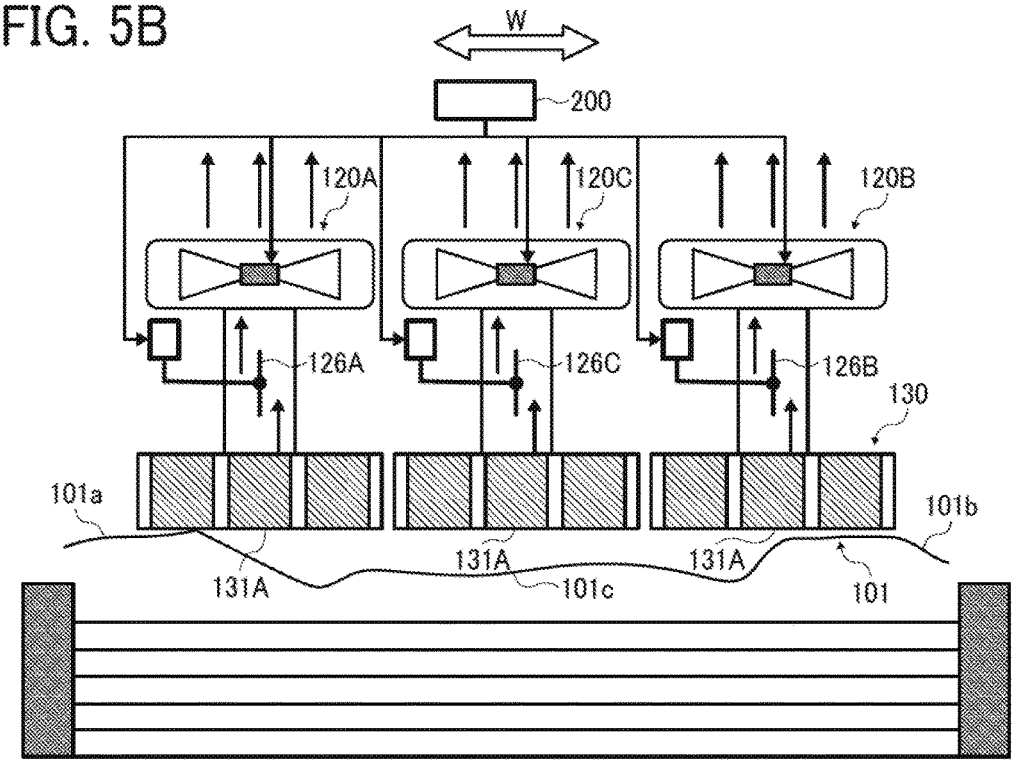
Figure 5C:
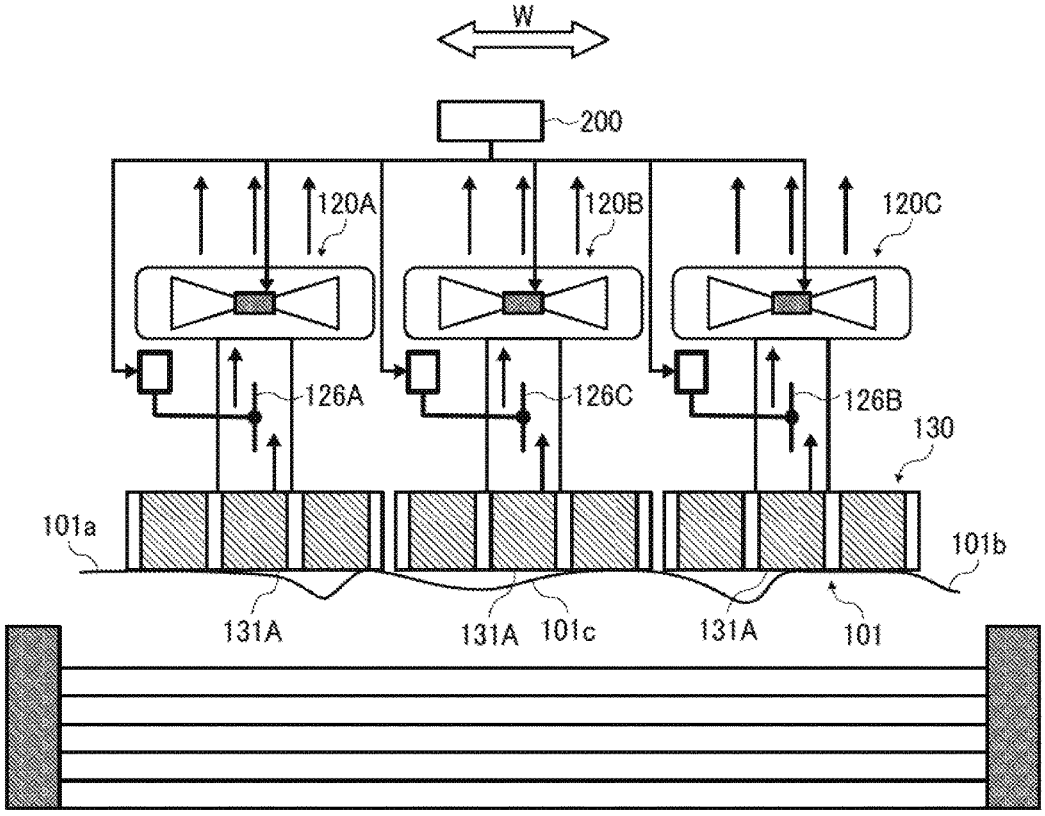

FIGS. 5A to 5C are cross-sectional view of one of an example of a medium-suction apparatus. As illustrated in FIGS. 5A to 5C, the medium-suction apparatus includes a plurality of suction units 120A, 120B, and 120C disposed along a width direction W of the medium 101 (hereinafter, referred to as "width direction W"). The width direction W is a direction perpendicular to the conveyance direction A that is a direction along which the medium 101 is conveyed. The plurality of suction units 120A, 120B, and 120C may be disposed along the conveyance direction A. A mechanical configuration of the suction units 120A, 120B, and 120C in FIGS. 5A to 5C are similar to that of the suction units 120A, 120B, and 120C in FIG. 3.

The controller 200 opens one of the suction units 120A, 120B, and 120C using one of the shutters 126A, 126B, and 126C, which acts as a control valve, or simultaneously opens a plurality of shutters 126A, 126B, and 126C of the plurality of suction units 120A, 120B, and 120C to attract the medium 101 to the suction face 131A of the conveyance belt 131 as illustrated in FIGS. 5A to 5C.

In the configuration as illustrated in FIGS. 5A to 5C, a posture of the medium 101 may change during a suction operation, and both ends 101*a* and 101*b* of the medium 101 in the width direction W may be attracted first to the suction face 131A of the conveyance belt 131 as illustrated in FIG. 5B. In this case, flexing occurs in a center part 101*c* of the medium 101 as illustrated in FIG. 5B. This flexing cause not only crease in the medium 101 but also cause jam of the medium 101 dining conveyance of the medium 101. The jam may occur when the medium 101 is caught on a convey guide of the conveyance device 130 during conveyance of the medium 101.

Therefore, the medium-suction apparatus 100 of the present disclosure regulates an operation order of the suction units 120A, 120B, and 120C in the width direction X to reduce the occurrence of the crease caused by the flexing of the medium 101.

FIGS. 6A to 6D are cross-sectional view of a medium-suction apparatus according to a first embodiment.

As illustrated in FIGS. 6A to 6D, the suction units 120A, 120B, and 120C according to the present embodiment include a plurality of shutters 126A, 126B, and 126C, respectively. The shutters 126A, 126B, and 126C are independently operable.

Figure 6A:
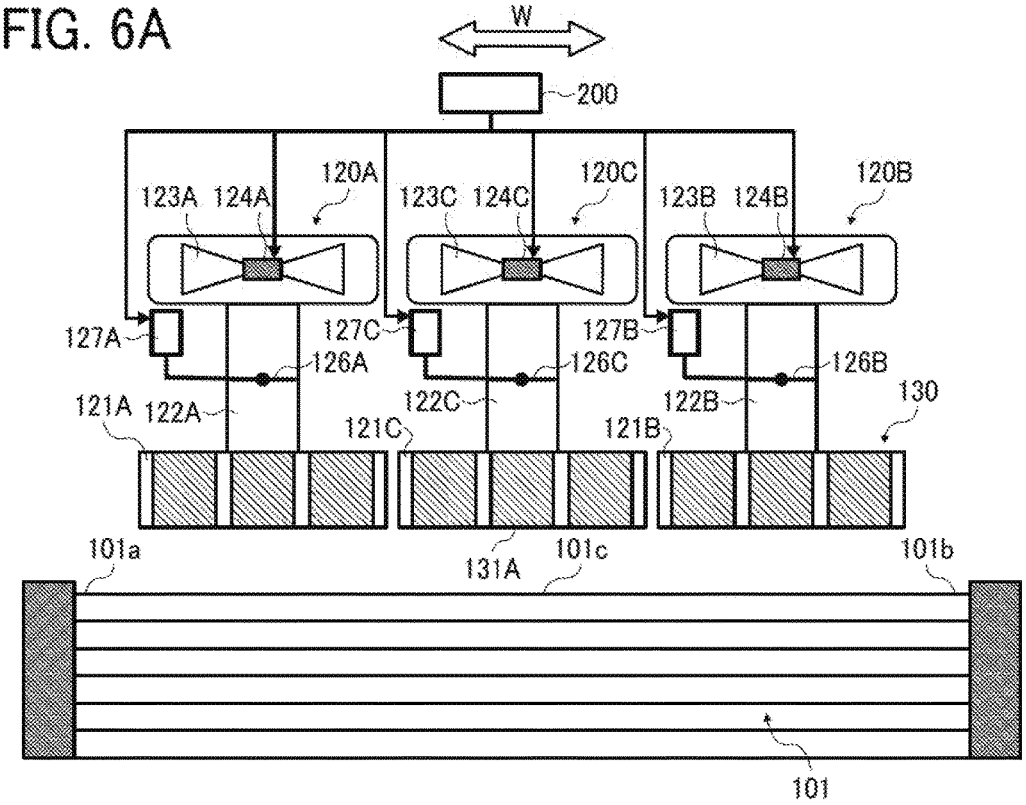
FIGS. 6A to 6D are cross-sectional views of a medium-suction apparatus according to a first embodiment.
Figure 6B:
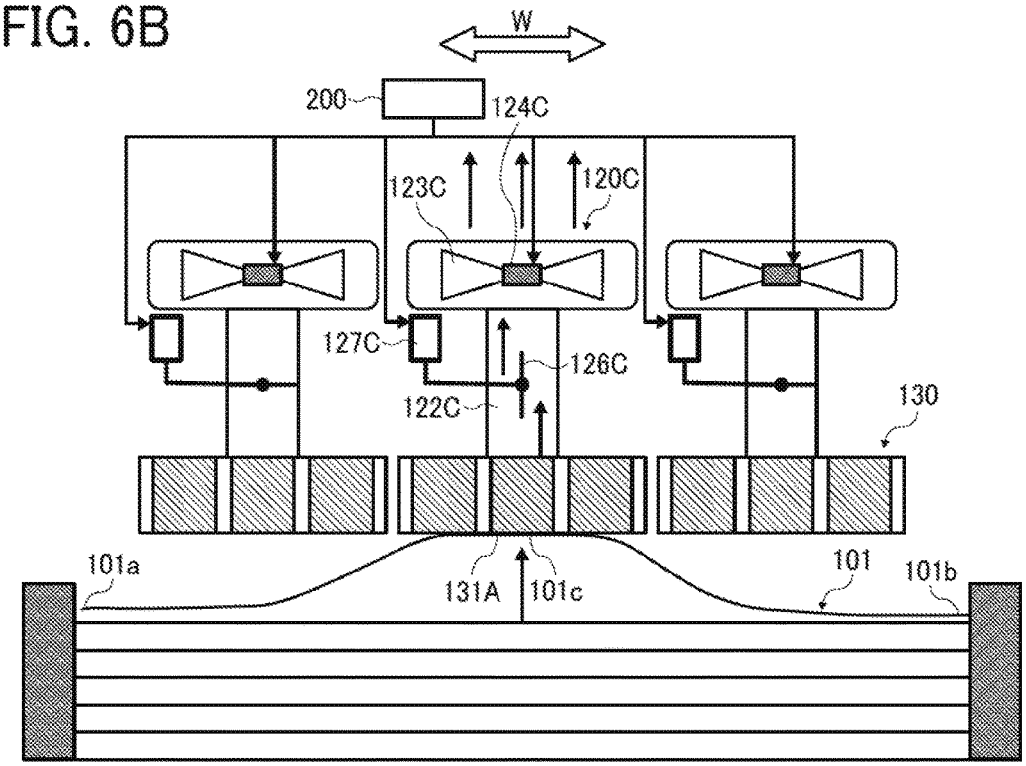

The controller 200 drives the suction drivers 124A, 124B, and 124C to rotate the suction blades 123A, 123B, and 123C to start a suction operation as illustrated in FIG. 6A. Then, as illustrated in FIG. 6B, the controller 200 operates the shutter 126C of the suction unit 120C to open the suction duct 122C to start attraction of a center part 101*c* of the medium 101 in the width direction W. The suction unit 120C is disposed to face the center part 101*c* of the medium 101 located between the both ends 101*a* and 101*b* of the medium 101 in the width direction W. The suction unit 120C is disposed above the center part 101*c* of the medium 101.

Thus, only the center part 101*c* of the medium 101 is attracted to the suction face 131A of the conveyance belt 131 first, and both ends 101*a* and 101*b* of the medium 101 are in a state that have not yet been attracted to the suction face 131A of the conveyance belt 131.

Figure 6C:
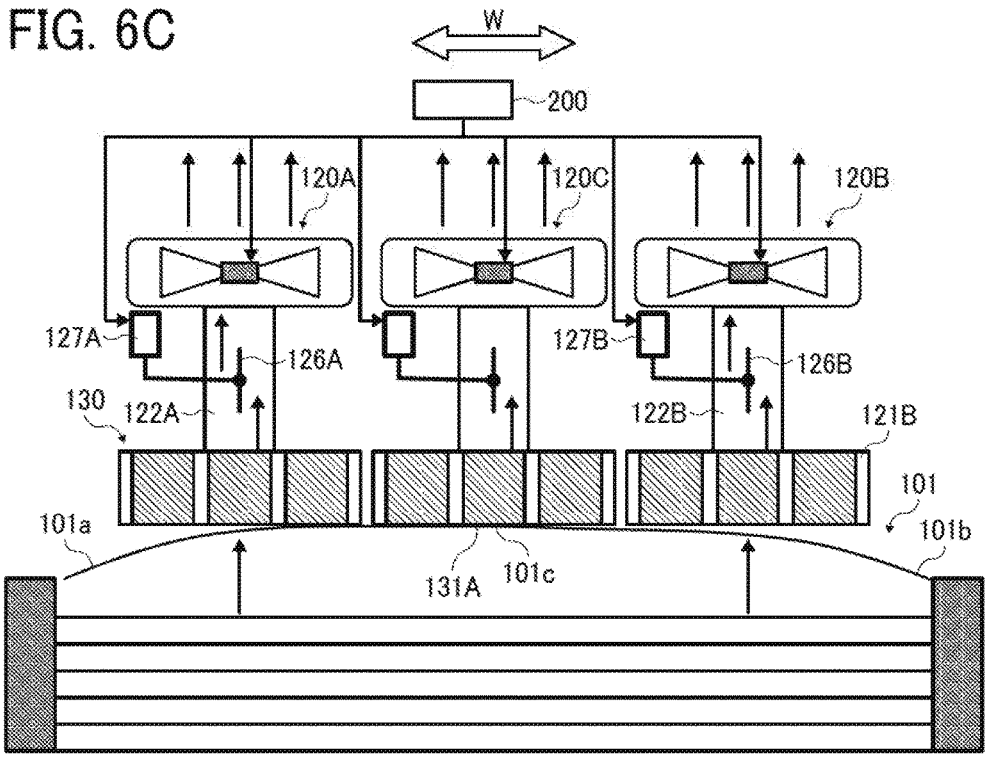
Figure 6D:
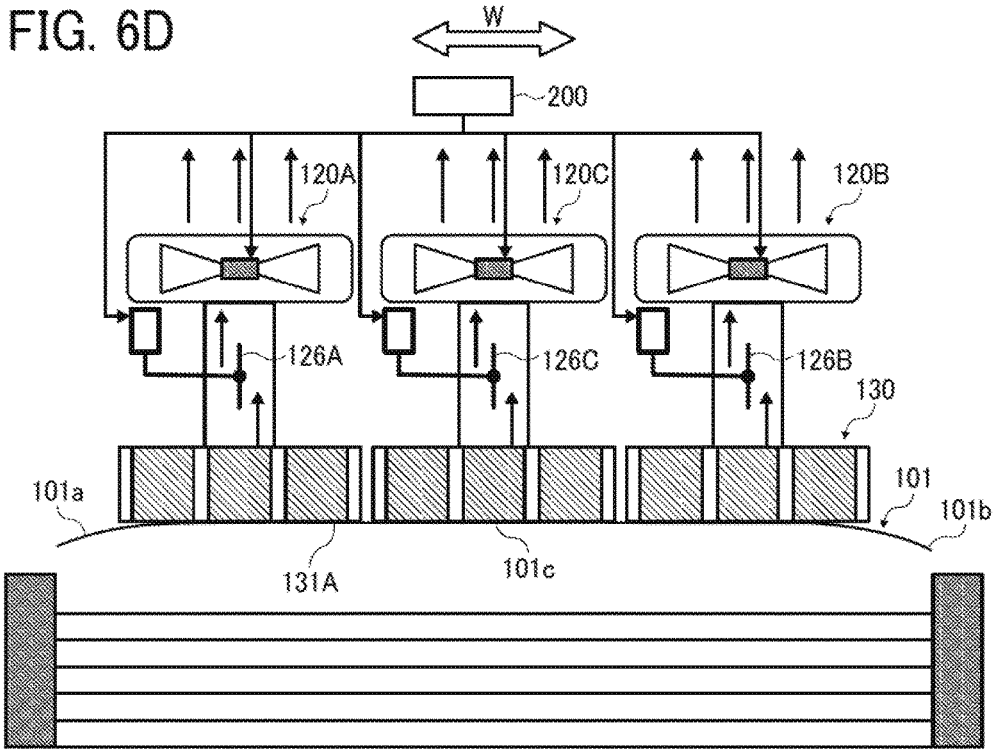

Next, as described in FIGS. 6C and 6D, the controller 200 operates the shutters 126A and 126B of the suction units 120A and 120B to open the suction ducts 122A and 122B to start attraction of both ends 101*a* and 101*b* of the medium 101 in the width direction W. The suction units 120A and 120B are disposed above the medium 101 and face the regions closed to both ends 101*a* and 101*b* of the medium 101, respectively.

Because the center part 101*c* of the medium 101 has been already attracted and contact on the suction face 131A, the medium 101 is gradually attracted to the suction face 131A from the center part 101*c* toward both ends 101*a* and 101*b* of the medium 101.

In this way, because the medium-suction apparatus 100 attracts the medium 101 from the center part 101*c* of the medium 101, the medium-suction apparatus 100 can simultaneously attracts both ends 101*a* and 101*b* of the medium 101 after the attraction of the center part 101*c*. Thus, the medium-suction apparatus 100 can suppresses the flexing of the medium 101 attracted to the suction face 131A in the width direction W. Thus, the medium-suction apparatus 100 can suppresses crease on the medium 101 occurred during attracting the medium 101 to the suction face 131A of the conveyance belt 131.

In the present embodiment, the medium-suction apparatus 100 including three suction units 120A, 120B, and 120C are described. However, the medium-suction apparatus 100 may have four suction units 120. In this case, the medium-suction apparatus 100 starts attracting the center part 101*c* of the medium 101 first and gradually attracts the medium 101 toward the both ends 101*a* and 101*b* of the medium 101. The medium-suction apparatus 100 has four suction units 120 thereby can attract the medium 101 to the suction face 131A while suppressing the flexing of the medium 101 in the width direction W and crease on the medium 101.

In the present embodiment, the suction unit 120C corresponds to a first suction unit, the suction unit 120A corresponds to a second suction unit, and the suction unit 120B corresponds to a third suction unit. When the medium-suction apparatus 100 is viewed from downstream side in the conveyance direction A (viewed from viewpoint of FIGS. 6A to 6D), the suction unit 120B (third suction unit) is disposed on an opposite side of the suction unit 120A (second suction unit) with respect to the suction unit 120C (first suction unit). In other words, the suction units 120A, 120B, and 120C are disposed in the order of the suction units 120A, 120C, and 120B from top to bottom in the width direction W in FIG. 2 and are disposed in the order of the suction units 120A, 120C, and 120B from left to right in the width direction W in FIGS. 6A to 6D.

During the suction operation, the suction unit 120C (first suction unit) starts a suction operation first, and then the suction unit 120A (second suction unit) and the suction unit 120B (third suction unit) simultaneously start the suction operations. The timing of start the suction operations of the suction unit 120A (second suction unit) and the suction unit 120B (third suction unit) does not necessary to be at the same time. For example, the suction unit 120A (second suction unit) may start the suction operation first, and then the suction unit 120B (third suction unit) may start suction operation.

Figure 7A:
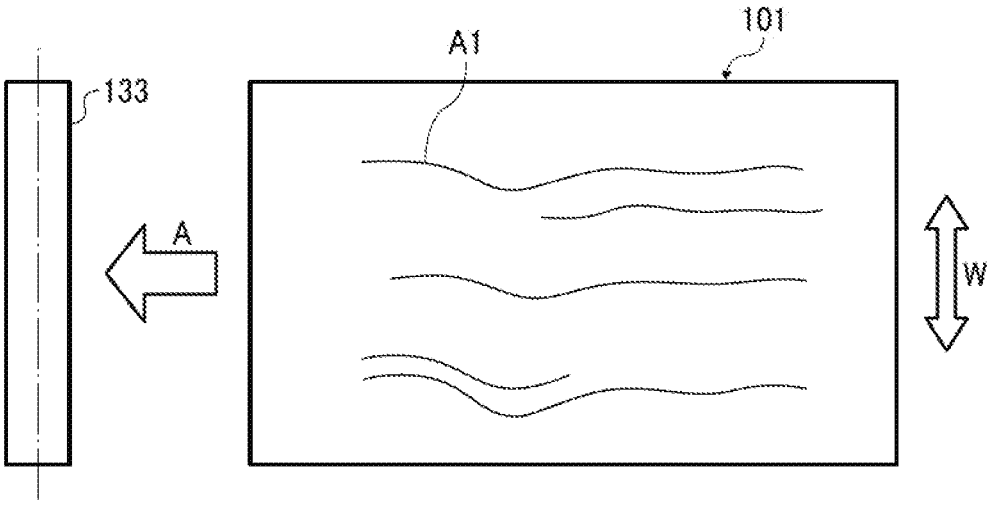
FIGS. 7A and 7B are schematic plan views of the medium and a conveyance roller.
Figure 7B:
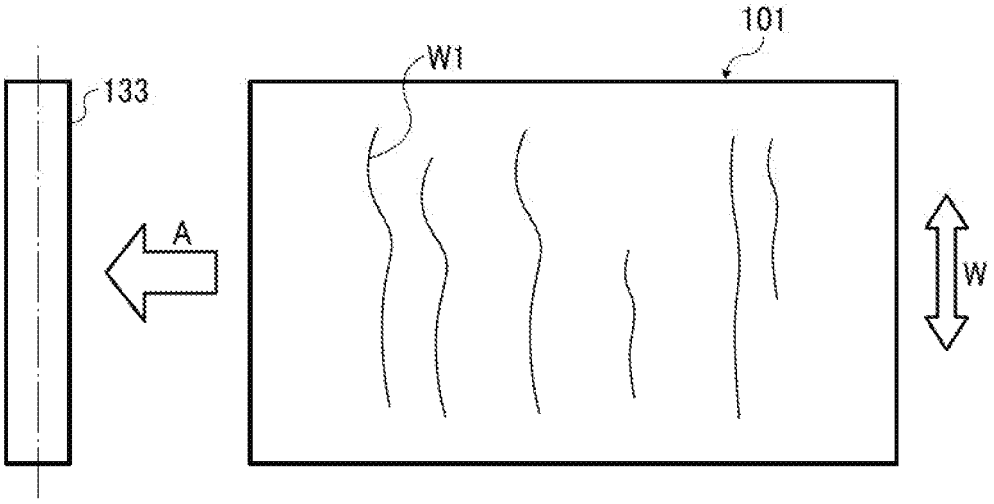

As illustrated in FIGS. 7A and 7B, the flexing of the medium 101 during conveyance of the medium 101 is roughly classified according to the following types. That is, a flexing occurs along the conveyance directions A (flexing A1), and flexing occurs along the width direction W (flexing W1) that is perpendicular to the conveyance direction A.

The flexing W1 occurring along the width direction W is parallel to the rotation axis of the conveyance roller 133 (or conveyance belt 131). Therefore, it is possible to extend the flexing W1 by controlling drive timing of the conveyance roller 133, for example. Thus, it is possible to remove the flexing W1 to some extent even if the flexing W1 occurs.

However, it is difficult to remove the flexing A because the flexing A1 is extending along the conveyance direction A, which is perpendicular to a direction parallel with the rotation axis of the conveyance roller 133. Thus, it is difficult to extend the flexing A1 in the middle of the conveyance of the medium 101. The medium 101 having the flexing A1 is easily having crease that becomes the cause of jam, etc. The crease is occurred when the medium 101 having the flexing A1 is pressed with the conveyance roller 133 or the conveyance belt 131.

The present embodiment suppress the occurrence of the flexing A1 by disposing the suction units 120A, 120B, and 120C along the width direction W perpendicular to the conveyance direction A.

The medium-suction apparatus 100 as illustrated in FIGS. 5A to 5C includes suction units 120A, 120B, and 120C disposed along the width direction W to suction the medium 101. However, with the medium-suction apparatus 100 as illustrated in FIGS. 5A to 5C it is difficult to effectively suppress the flexing A because it does not control the order (timing) of starting the suction operation of the suction units 120A, 120B, and 120C in the width direction W.

By contrast, the medium-suction apparatus 100 as illustrated in FIGS. 6A to 6D of the present embodiment includes suction units 120A, 120B, and 120C disposed along the width direction W. Further, the medium-suction apparatus 100 controls the order (timing) of starting the suction operation of the suction units 120A, 120B, and 120C in the width direction W, thereby suppressing the occurrence of the flexing A.

If the suction units 120A, 120B, and 120C are disposed along the conveyance direction A, a suction area of the suction units 120A, 120B, and 120C becomes long in a longitudinal direction of the medium 101 parallel to the conveyance direction A. If the suction area of the suction units 120A, 120B, and 120C is long in a longitudinal direction of the medium 101, flexing occurs easily caused by flexing gaps existed in the medium 101 and by uneven suction of the suction units 120A, 120B, and 120C.

Because the suction units 120A, 120B, and 120C in the present embodiment are disposed along the width direction W, flexing is suppressed because fewer flexing gaps existed in the medium 101. Further, the suction units 120A, 120B, and 120C can perform uniform suction operations to suppress flexing of the medium 101 compared to the suction units 120A, 120B, and 120C disposed along the conveyance direction A.

Second Embodiment

In the first embodiment, the suction unit 120C starts attraction of the center part 101*c* first. The suction unit 120C is disposed above the center part 101*c* of the medium 101. After that, the suction units 120B and 120C start attraction of both ends 101*a* and 101*b* of the medium 101. The suction units 120B and 120C are disposed above the ends 101*a* and 101*b* of the medium 101, respectively. Thereby, the medium-suction apparatus 100 can suppress the flexing of the medium 101 in the width direction W and crease on the medium 101.

By contrast, as illustrated in FIGS. 8A to 8D, the medium-suction apparatus 100 of the second embodiment controls the suction units 120A, 120B, and 120C such that the suction operation is started in an order of the suction unit 120A, the suction unit 120C, and the suction unit 120B. The medium-suction apparatus 100 may control the suction units 120A, 120B, and 120C such that the suction operation is started in an order of the suction unit 120B, the suction unit 120C, and the suction unit 120A. Thus, the medium 101 is attracted to the suction face 131A of the conveyance belt 131 in an order from the end 101*a* toward the end 101*b* of the medium 101 or from the end 101*b* toward the end 101*a* of the medium 101 in the width direction W.

In the present embodiment, the order of starting suction operation of the suction units 120A, 120B, and 120C is in order of the suction unit 120A, the suction unit 120C, and the suction unit 120B. Here, the suction units 120A, 120B, and 120C respectively drive the suction drivers 124A, 124B, and 124C to rotate the suction blades 123A, 123B, and 123C to start suction process. Then, the suction units 120A, 120B, and 120C operate the shutter drivers 127A, 127B, and 127C acting as control valves to move the shutters 126A, 126B, 126C in an opening direction to open the suction ducts 122A, 122B and 122C.

Figure 8A:
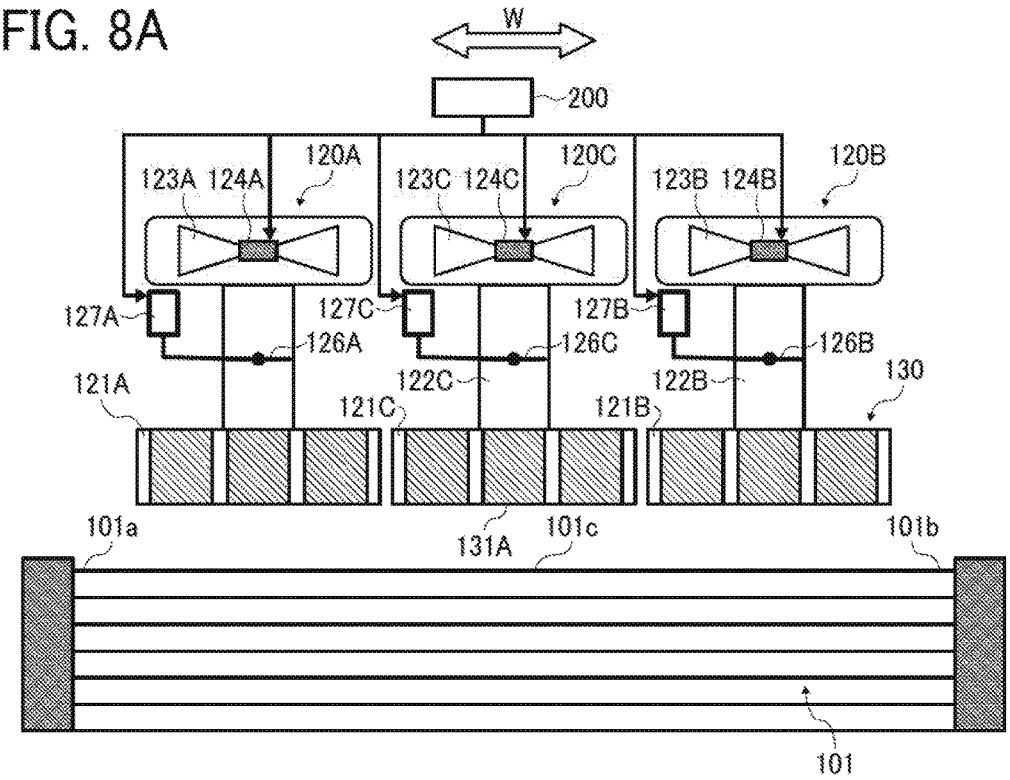
FIGS. 8A to 8D are schematic cross-sectional views of a medium-suction apparatus according to a second embodiment.
Figure 8B:
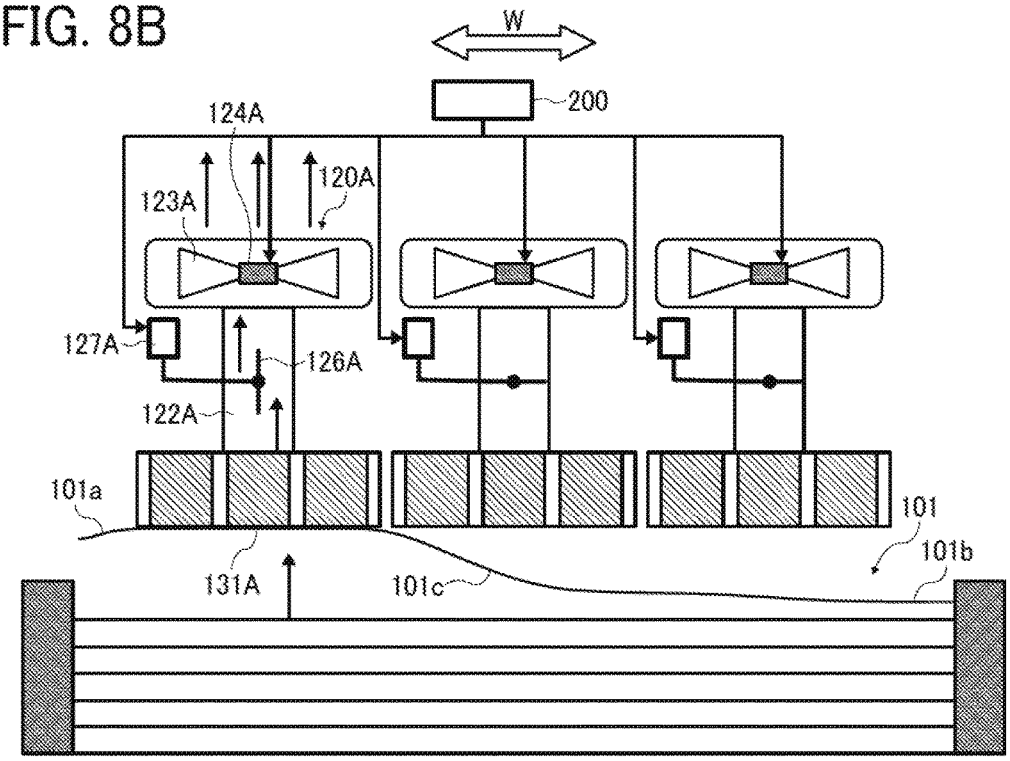

Thus, the controller 200 chives the suction drivers 124A, 124B, and 124C to rotate the suction blades 123A, 123B, and 123C to start the suction process as illustrated in FIG. 8A. Then, as illustrated in FIG. 8B, the controller 200 chives the shutter driver 127A to open the suction duet 122A to start attraction of the end 101*a* of the medium 101 in the width direction W. At this time, only one end 101*a* of the medium 101 is attracted to the suction face 131A of the conveyance belt 131 as illustrated in FIG. 8B.

Figure 8C:
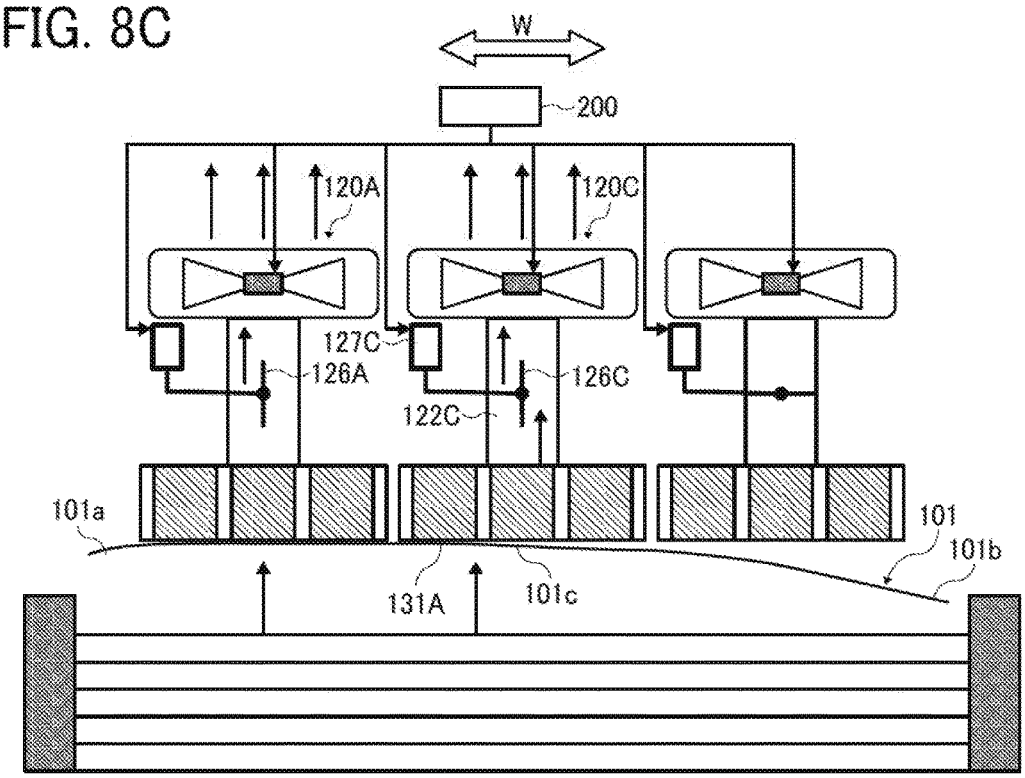
Figure 8D:
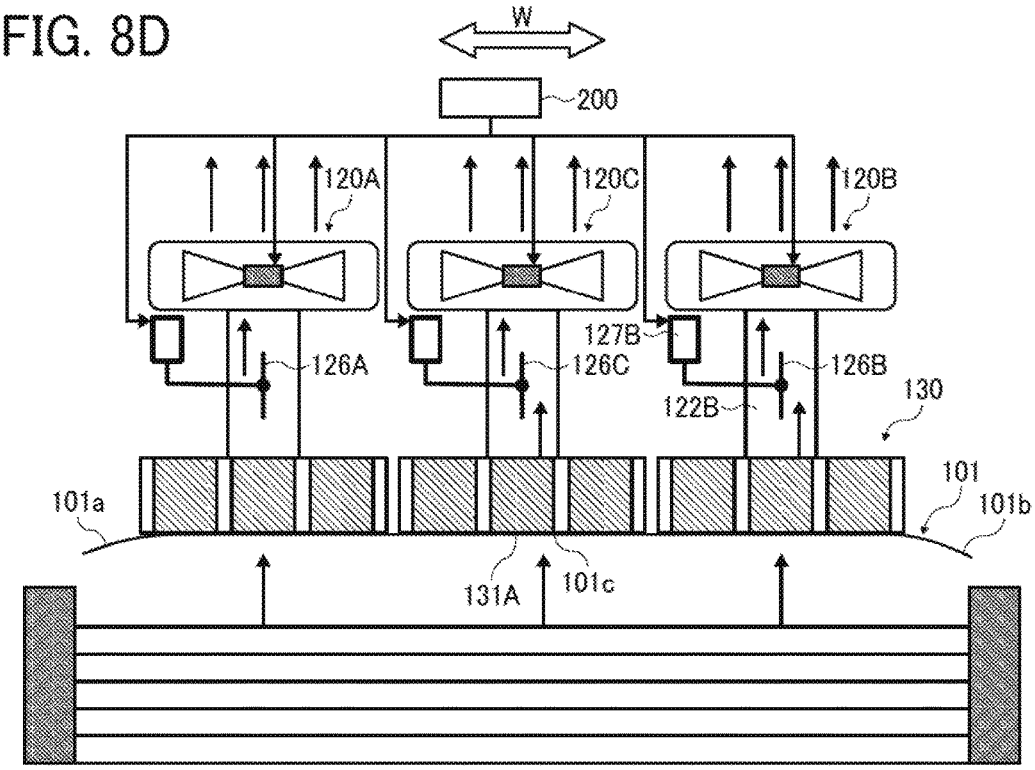

Next, as illustrated in FIGS. 8C and 8D, the controller 200 controls the shutter driver 127C to drive the shutter 126C to open the suction duct 122C, and then controls the shutter driver 127B to drive the shutter 126B to open the suction duct 122B. In this way, the controller 200 gradually shifts the timing of start driving of the shutter drivers 127A, 127B, and 127C in the order of the shutter driver 127A, the shutter driver 127C, and the shutter driver 127B. Because the one end 101*a* has been already attracted and contact on the suction face 131A, the medium 101 is gradually attracted to the suction face 131A from one end 101*a* toward another end 101*b* of the medium 101 along the width direction W.

In this way, because the medium-suction apparatus 100 attracts the medium 101 from the one end 101*a* toward another end 101*b* in the width direction W the medium-suction apparatus 100 can suppresses the flexing of the medium 101 caused by simultaneously attracting the both ends 101*a* and 101*b* of the medium 101. Thus, the medium-suction apparatus 100 can suppresses crease on the medium 101 occurred during attracting the medium 101 to the suction face 131A of the conveyance belt 131.

In the present embodiment, the suction unit 120A corresponds to a first suction unit, the suction unit 120C corresponds to a second suction unit, and the suction unit 120B corresponds to a third suction unit. When the medium-suction apparatus 100 is viewed from downstream side in the conveyance direction A (viewed from viewpoint of FIGS. 8A to 8D), the suction unit 120B (third suction unit) is disposed on an opposite side of the suction unit 120A (first suction unit) with respect to the suction unit 120C (second suction unit).

During the suction operation, first, the suction unit 120A (first suction unit) starts suction operation, secondly, the suction unit 120C (second suction unit) starts suction operation, and thirdly (finally) the suction unit 120B (third suction unit) starts suction operation. The second embodiment is described using the example of using three suction units 120A, 120B, and 120C aligned in line in the width direction W. However, as illustrated in FIGS. 9A to 9C, the medium-suction apparatus 100 may include two suction units 120A and 120B, for example.

Figure 9A:
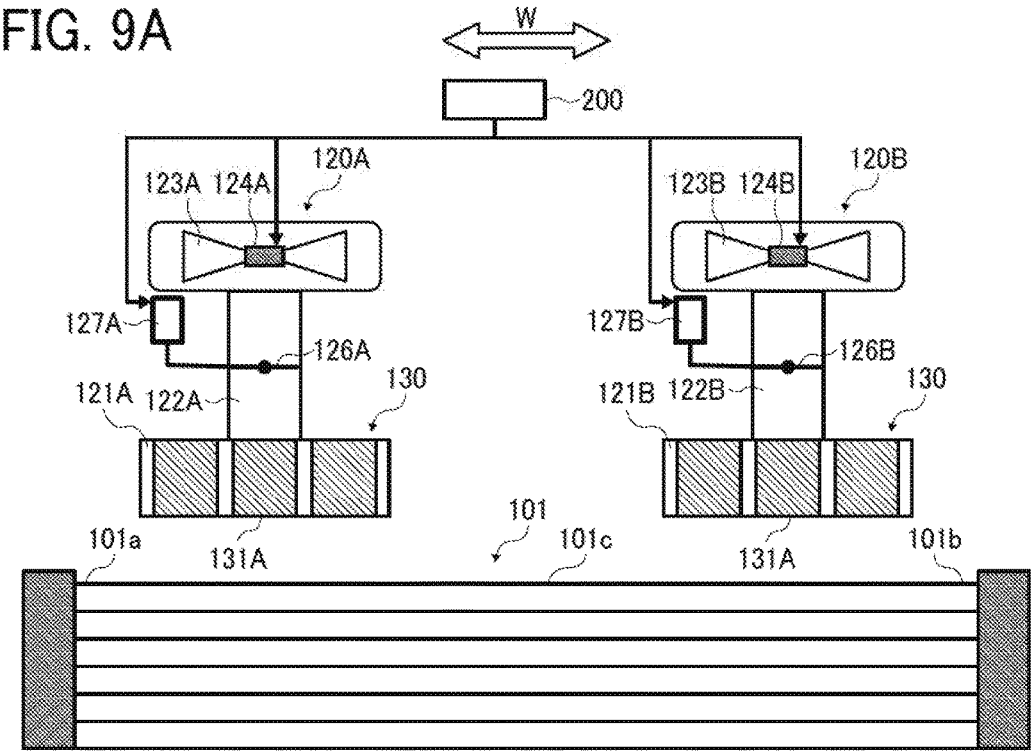
FIG. 9A to 9C schematic cross-sectional views of a medium-suction apparatus according to still another embodiment.
Figure 9B:
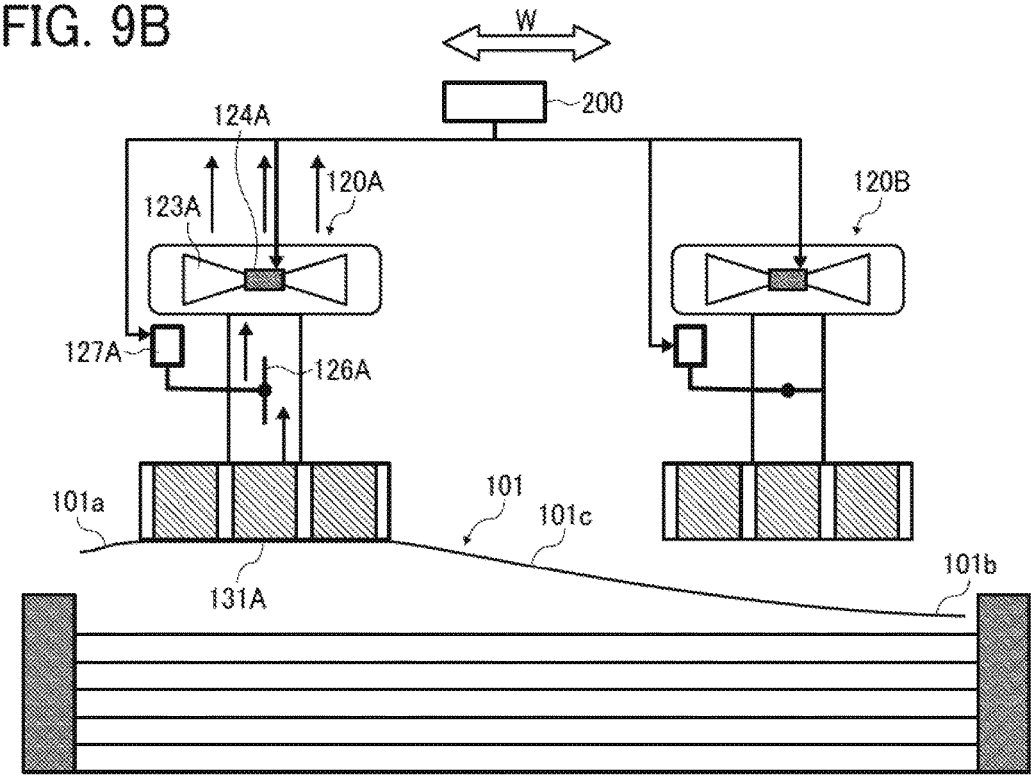
Figure 9C:
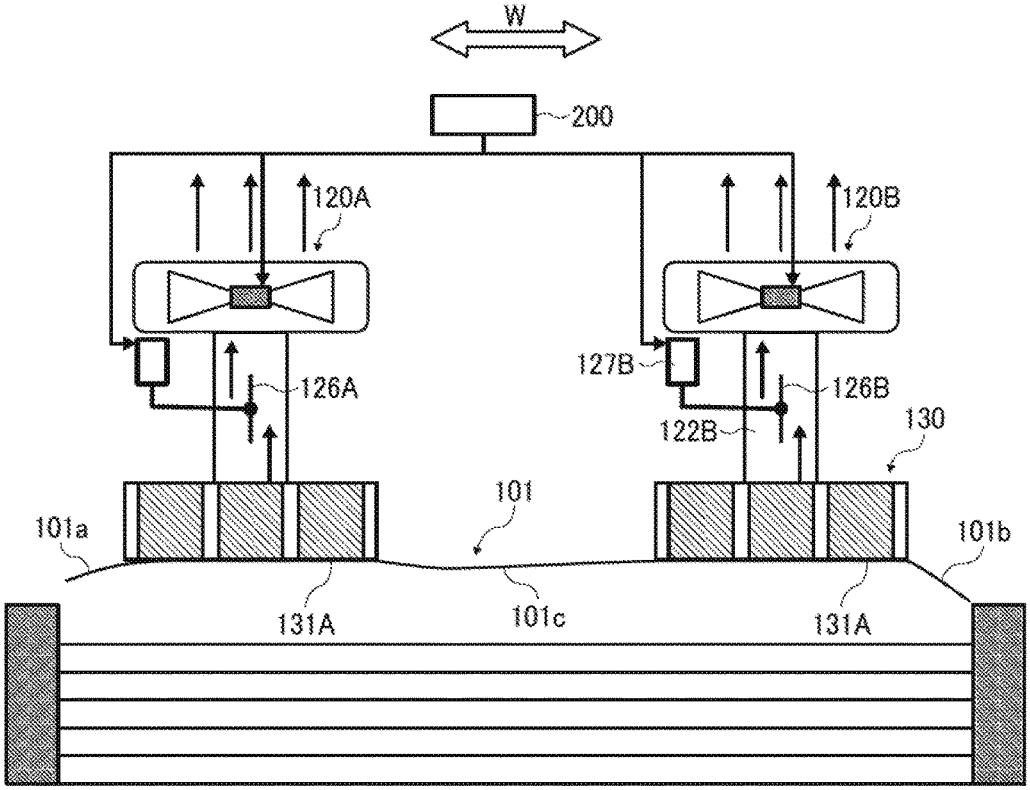

In this case, the controller 200 respectively drives the suction drivers 124A and 124B to rotate the suction blades 123A and 123B to start the suction operation as illustrated in FIG. 9A. Then, as illustrated in FIG. 9B, the controller 200 drives the shutter driver 127A to open the suction duct 122A to start attraction of the end 101*a* of the medium 101 in the width direction W. Next, as described in FIG. 9C, after passing of predetermined time, the controller 200 operates the shutter driver 127B to drive the shutter 126B of the suction unit 120B to open the suction duct 122B to start attraction of end 101*b* of the medium 101 in the width direction W.

The "predetermined time" described here is time until at least the end 101*a* is attracted to the suction face 131A. More preferably, "predetermined time" is the time until one third or half of the medium 101 in the width direction W is attracted to the suction face 131A of the conveyance belt 131. The predetermined time is previously determined by such as experiment. For example, time from the start of operation of the shutter driver 127A is measured using such as timer, and the measured time and the predetermined time is compared using such as controller 200. The controller 200 then controls the operation timing of the shutter driver 127B according to the results of comparison.

With this configuration, the medium-suction apparatus 100 attracts the medium 101 to the suction face 131A of the conveyance belt 131 from one end 101*a* toward another end 101*b* of the medium 101 in the width direction W. Therefore, the medium-suction apparatus 100 can suppresses the flexing of the medium 101 occurred by simultaneously attracting both ends 101*a* and 101*b* of the medium 101 to the suction face 131A. Thus, the medium-suction apparatus 100 can suppresses crease on the medium 101 occurred during attracting the medium 101 to the suction face 131A of the conveyance belt 131.

The present embodiment illustrated in FIGS. 9A to 9C includes two suction units 120A and 120B. The suction unit 120A corresponds to a first suction unit, and the suction unit 120B corresponds to a second suction unit. When the medium-suction apparatus 100 is viewed from downstream side in the conveyance direction A (viewed from viewpoint of FIGS. 9A to 9C), the suction unit 120A (first suction unit) and the suction unit 120E (second suction unit) are arranged next to each other in the width direction W.

During the suction operation, the suction unit 120A (first suction unit) starts suction operation, and then the suction unit 120B (second suction unit) starts suction operation.

Third Embodiment

A description is now given of a configuration of the third embodiment and the controller 200 of the medium-suction apparatus 100. The controller 200 is not only applicable to the third embodiment but also applicable to other embodiments in the present disclosure to control the suction operation of each suction unit 120A, 120B, and 120C.

The third embodiment of the present disclosure controls a timing of starting the suction operation of the plurality of suction units 120A, 120B, and 120C according to the type (a predetermined characteristic) of medium 101 using controller 200. In the third embodiment, the type (the predetermined characteristic) of the medium 101 indicates a thickness X of the medium 101. Here, basis weight (g/m$^2$) of the medium 101 is used as a criterion to determine the thickness X of the medium 101.

More specifically, the third embodiment of the present disclosure controls a timing of starting the suction operation of the plurality of suction units 120A, 120B, and 120C according to the thickness X of the medium 101 using controller 200. Specifically the controller 200 adjusts the time intervals between starts of the suction operations of the suction unit 120C (first suction unit), the suction unit 120A (second suction unit), and the suction unit 120B (third suction unit) according to the thickness X of the medium 101. The controller 200 controls the interval of when the thickness X of the medium 101 is less than a predetermined value X1 to be greater than the interval of when the thickness X of the medium 101 is not less than the predetermined value X1.

Thus, the controller 200 adjusts time intervals between starts of the suction operations of the suction units 120A, 120B, and 120C according to the thickness X of the medium. Further, the controller 200 lengthens the time interval when the thickness X of the medium is less than a predetermine value X1 compared to the thickness X of the medium is not less than the predetermine value X1.

In other words, the controller 200 controls a difference of operation timing among the plurality of suction units 120A, 120B, and 120C when the thickness X of the medium is not less than a predetermined value X1 to be smaller than the difference of the operation timing among the suction units 120A, 120B and 120C when the thickness X of the medium is less than a predetermined value X1.

The controller 200 controls a difference of operation timing among the plurality of suction units 120A, 120B, and 120C when the thickness X of the medium is not less than a predetermined value X1 to be smaller than the difference of the operation timing among the suction units 120A, 120B, and 120C when the thickness X of the medium is less than a predetermined value X1.

Here, the suction units 120A, 120B, and 120C similar to the first embodiment is supposed to be used as a suction units, and the suction unit 120C is first to be operated and then the suction units 120A and 120C are simultaneously operated as illustrated in FIGS. 6A to 6D. In this case, the order of suction operation of the suction units 120A, 120B, and 120C is identical regardless of the thickness X of the medium 101. The order of operation of the suction units is such that the suction unit 120C is first to be operated, and the suction units 120A and 120B are next to be operated.

However, in the third embodiment, intervals between the timing of starting the suction operation of each of the suction units 120A, 120B, and 120C are changed according to the thickness X of the medium X. Here, the interval is a time difference between the start of the operation of the suction unit 120C and the start of the operation of the suction units 120A and 120B.

Figure 10:
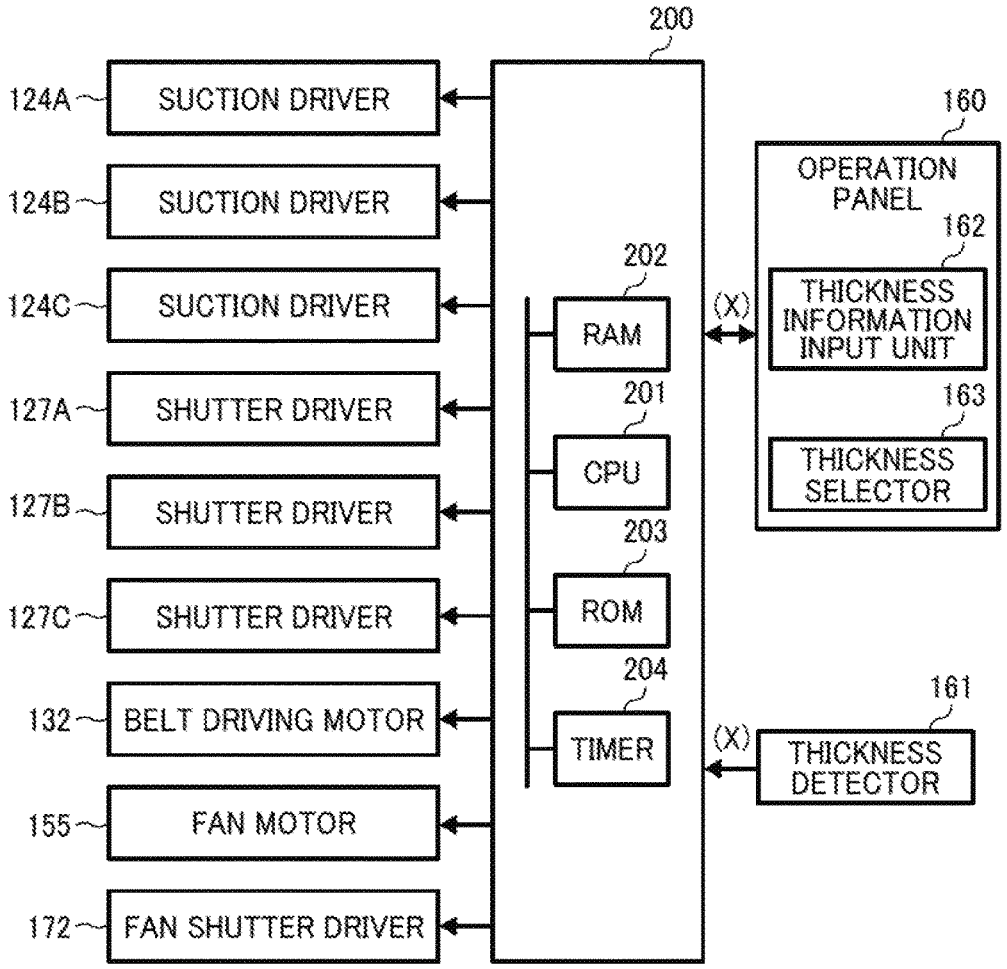
FIG. 10 is a block diagram illustrating a configuration of a control system of a medium-suction apparatus according to a third embodiment.
Figure 11:
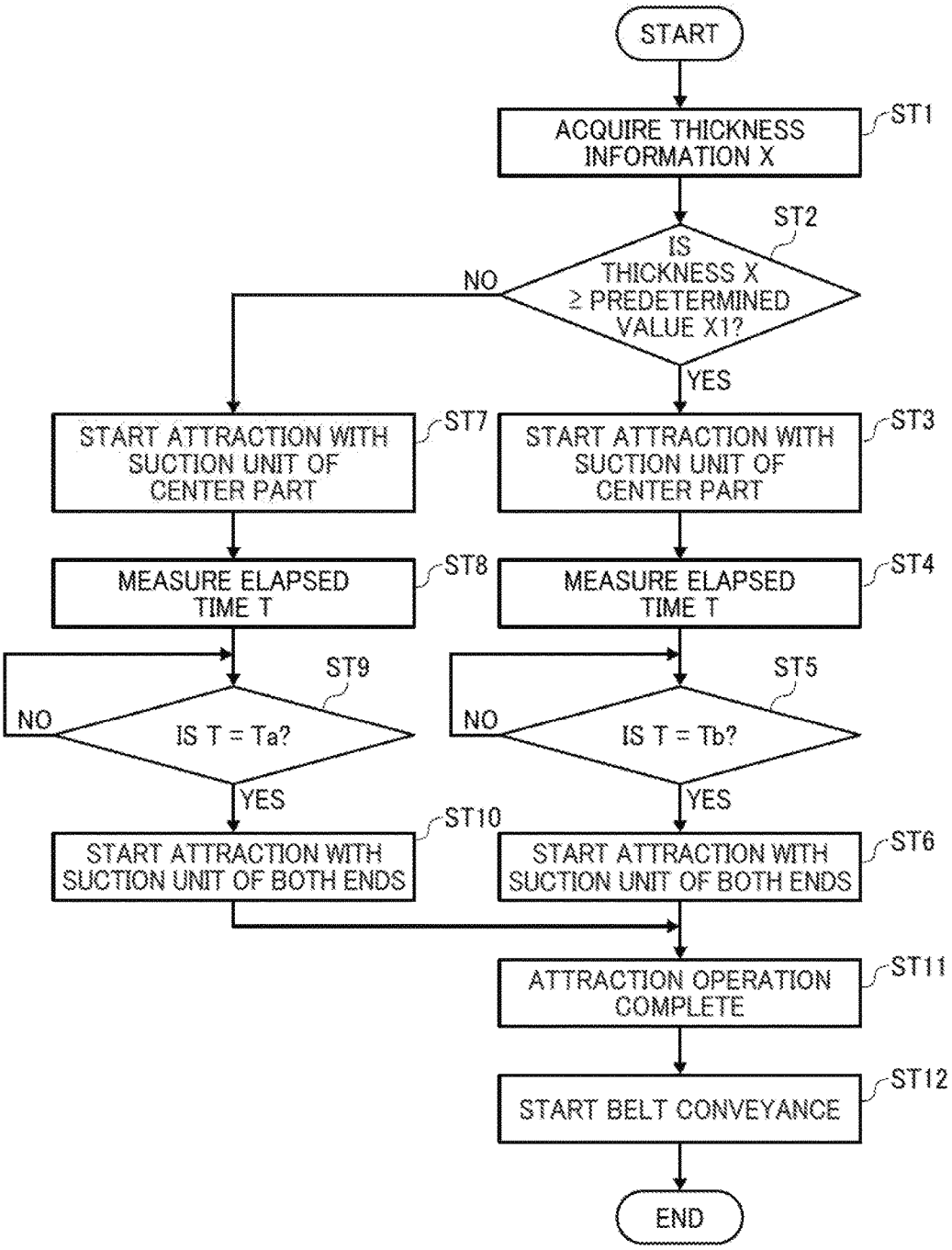
FIG. 11 is a flowchart of suction operation of the medium-suction apparatus according to the third embodiment.

With reference mainly to FIGS. 10 and 11, the control of the intervals is described. FIG. 10 is a block diagram illustrating a functional structure of a controller 200 of the medium-suction apparatus 100 according to the present embodiment. FIG. 11 illustrates a flow chart of the suction operation of the controller 200 according to the third embodiment.

In FIG. 10, the controller 200 includes a computer that includes a central processing unit (CPU) 201, a random-access memory (RAM) 202, a read-only memory (ROM) 203, and a timer 204. At an input side of the controller 200, an operation panel 160 and a thickness detector 161 are connected to the controller 200 via signal line. The CPU 201 (processor) acts as a controller 200 in FIGS. 1 to 15 processor. The operation panel 160 includes a touch panel and acts as an input unit to input various information. The thickness detector 161 has a sensor to detect the thickness X of the medium 101. A thickness information input unit 162 and a thickness selector 163 are displayed on the operation panel 160 as switches. The thickness information input unit 162 is for inputting information of thickness X of the medium 101 to the controller 200. The thickness selector 163 is for selection of thickness X of the medium 101.

In the present embodiment, the information of the thickness X selected from the information of the thickness X detected by the thickness detector 161, the information of the thickness X input from the thickness information input unit 162, and the information of the thickness X selected by thickness selector 163, may be used as the information of the thickness X of the medium 101. The present embodiment may include at least one of the thickness detector 161, the thickness information input unit 162 and the thickness selector 163 and does not necessarily include all them.

An output side of the controller 200 is connected with the suction drivers 124A, 124B, and 124C, the shutter drivers 127A, 127B, and 127C, the belt driving motor 132, fan motor 155, and fan shutter driver 172 via signal lines. The controller 200 operates to tarn on and turn off the suction drivers 124A, 124B, and 124C, the shutter drivers 127A, 127B, and 127C, the belt driving motor 132, the fan motor 155, and the fan shutter driver 172 according to an operation timing stored in the ROM 203 of the controller 200. The ROM 203 of the controller 200 previously stores the predetermined value X1 for determining the thickness X. This predetermined value X1 may be changed arbitrarily. The ROM 203 of the controller 200 previously stores time Ta and Tb as an interval of timing of starting the suction operation of the first suction unit 120C and the suction units 120A and 120B. The time Ta is set to be greater than the time Tb (Ta>Tb).

FIG. 11 is a flow chart of a control operation of the suction units 120A, 120B, and 120C of the controller 200 of the medium-suction apparatus 100 according to the third embodiment of the present disclosure. In the present embodiment, it is assumed that the suction units 120A, 120B, and 120C have been already in an operation mode. The controller 200 acquires thickness X information (basis weight) of the medium 101 from the thickness detector 161, the thickness information input unit 162, or the thickness selector 163 in step ST1, and the process goes to step ST2.

The controller 200 compares the thickness X and the predetermined value X1 (for example, basis weight of 70 $g/m^2$) in step ST2 and determines whether the thickness X of the medium 101 is not less than the predetermined value X1. It is not necessary to convert the thickness X to basis weight. If the thickness X of the medium 101 is not less than the predetermined value X1, the process goes to step ST3.

In step ST3, the controller 200 starts attraction of the medium 101 with the suction unit 120C that faces to the center part 101*c* of the medium 101, then the process goes to step ST4. In step ST3, the controller 200 operates the shutter driver 127C to drive the shutter 126C of the suction unit 120C to open the suction duct 122C to start attraction of the center part 101*c* of the medium 101.

The controller 200 measures the elapsed time T after the start of the operation of the shutter driver 127C with the timer 204 in step ST4. The process goes to step ST6 when the elapsed time T becomes the time Tb in step ST5. The controller 200 operates the shutter drivers 127A and 127B to drive the shutters 126A and 126B to open the suction ducts 122A and 122B to start attraction of both ends 101*a* and 101*b* of the medium 101 with the suction units 120A and 120B in step ST6. Then, the process goes to step ST11.

If the thickness X of the medium 101 is less than the predetermined value X1 in step ST2, the process goes to step ST7. In step ST7, the controller 200 starts attraction of the center part 101*c* of the medium 101 with the suction unit 120C. Then, the process goes to step ST5. In step ST7, the controller 200 operates the shutter driver 127C to drive the shutter 126C of the suction unit 120C to open the suction duct 122C to start attraction of the center pan 101*c* of the medium 101.

The controller 200 measures the elapsed time T after the start of the operation of the shutter driver 127C with the timer 204 in step ST8. The process goes to step ST10 when the elapsed time T becomes the time Ta in step ST9. Then, the process goes to step ST10. The controller 200 operates the shutter drivers 127A and 127B to drive the shutters 126A and 126B to open the suction ducts 122A and 122B to start attraction of both ends 101*a* and 101*b* of the medium 101 with the suction units 120A and 120B in step ST10.

The controller 200 controls an interval between the timing of starting the suction eta operation of each of the suction unit 120C (first suction unit) and the suction units 120A (second suction unit) and suction unit 120B (third suction unit) according to the thickness X of the medium 101. The controller 200 controls the interval of when the thickness X of the medium 101 is less than a predetermined value X1 to be greater than the interval of when the thickness X of the medium 101 is not less than the predetermined value X1.

In other words, the controller 200 controls a difference of an operation timing between the suction unit 120C and the suction units 120A and 120B when the thickness X of the medium 101 is less than the predetermined value X1 to be greater than the difference of the operation timing between the suction unit 120C and the suction units 120A and 120B when the thickness X of the medium is not less than the predetermined value X1. In the present embodiment, the times Ta and Tb are set to 0 [msec]≤Tb<Ta. If Tb is set to zero minute, the controller 200 simultaneously opens the suction ducts 122A, 122B, and 122C by simultaneously driving the shutter drivers 127A, 127B, and 127C of the suction units 120A, 120B, and 120C.

In other words, the controller 200 controls the difference of the operation timing between the suction unit 120C and the suction units 120A and 120B when the thickness X of the medium is not less than the predetermined value X1 to be smaller than the difference of the operation timing between the suction unit 120C and the suction units 120A and 120B when the thickness X of the medium is less than a predetermined value X1. The basis weight of 70 $g/m^2$, which is described as the predetermined value X1, is one example of the basis weight. The basis weight is not limited to this value.

In step ST11, the controller 200 determine an completion of the suction operation of the medium 101 to the suction face 131A of the conveyance belt 131 based on the elapsed time from the start of the operation of a sensor such as a thickness detector 161 or the elapsed time from the start of the operation of the shutters 126A and 126B, for example. Then, the controller 200 operates the belt driving motor 132 of the conveyance device 130 to start conveyance of the medium 101 with the conveyance belt 131 and completes the suction operation.

In this way, the controller 200 acquires the thickness X of the medium 101 and changes the operation timing between the suction unit 120C (shutter 126C) and the suction units 120A and 120B (shutters 126A and 126B) based on the acquired information of thickness X (basis weight), and thereby perform an appropriate suction operation according to the thickness X of the medium 101.

Thus, if the medium 101 is less stiff such as thin paper, flexing of the medium 101 in the width direction W occurs easily. Then, the controller 200 increase the difference of an operation timing between the suction unit 120C, which is first to start operation, and the suction units 120A and 120B, which are second to start operation. Thus, the controller 200 provides an interval between two operation timing for a degree to suppress the occurrence of the flexing. The medium-suction apparatus 100 can thereby reduce the occurrence of the crease caused by the flexing of the medium 101.

Thus, the controller 200 adjusts time intervals between starts of the suction operations of the suction units 120C, 120A, and 120B (first suction unit, the second suction unit, and the third suction unit, respectively) according to the thickness X of the medium 101, and the controller 200 lengthens the time interval when the thickness X of the medium 101 is less than a predetermined value X1 compare to when the thickness X of the medium 101 is not less than the predetermined value X1.

Further, the controller 200 adjusts time intervals between starts of the suction operations of the first suction unit, the second suction unit, and the third suction unit according to the basis weight of the medium, and the controller 200 lengthens the time intervals when the basis weight of the medium 101 is less than a predetermined value compared to when the basis weight of the medium 101 is not less than the predetermined value.

If the medium 101 is stiff such as thick paper, the medium 101 does not easily flex in the width direction W. Then, the controller 200 may reduce the difference of an operation timing between the suction unit 120C, which is first to start operation, and the suction units 120A and 120B, which are second to start operation. The controller 200 may simultaneously start operate the plurality of the suction units 120A, 120B, and 120C in certain circumstances.

In this way, the medium-suction apparatus 100 of the present embodiment reduces the difference of the operation time of the suction unit 120C and the suction units 120A and 120B in case of stiffer medium 101. Thus, it is possible to reduce the time from the start of the suction operation to the time, in which the medium 101 is attracted to the suction face 131A of the conveyance belt 131 and is start to be conveyed by the conveyance belt 131. Thereby, this embodiment is advantageous in terms of productivity.

Because the thick medium 101 is stiff, it does not flex easily. Thus, it is possible to give priority to suction force and productivity. Therefore, the controller 200 may simultaneously start operation of the suction units 120A, 120B, and 120C.

That is, when the thickness X of the medium 101 is less than the predetermined value X1, the controller 200 adjusts the time intervals between starts of the suction operations of the suction units 120A, 120B, and 120C to be greater than the time intervals when the thickness X of the medium 101 is not less than the predetermined value X1. The medium-suction apparatus 100 can thereby reduce the occurrence of the crease caused by the flexing of the medium 101.

The controller 200 may control each suction units 120A, 120B, and 120C by directly acquiring information of the basis weight without acquiring the thickness X of the medium 101. That is, when the basis weight of the medium 101 is less than the predetermined value, the controller 200 adjusts the time intervals between starts of the suction operations of the plurality of suction units 120A, 120B, and 120C to be greater than the intervals when the basis weight of the medium 101 is not less than the predetermined value. The medium-suction apparatus 100 can thereby reduce the occurrence of the crease caused by the flexing of the medium 101.

Thus, the controller 200 adjusts time intervals between starts of the suction operations of the suction units 120A, 120B, and 120C according to the thickness X of the medium, and the controller 200 lengthens the time intervals of when the thickness of the medium is less than a predetermine value compared to when the thickness X of the medium is not less than the predetermine value.

Fourth Embodiment

The fourth embodiment of the present disclosure controls operation timing of the plurality of suction units 120A, 120B, and 120C according to a size of the medium 101 using controller 200. In the present embodiment, the size of the medium 101 is based on a particular set of standards, such as JIS (Japanese Industrial Standards).

Figure 12:
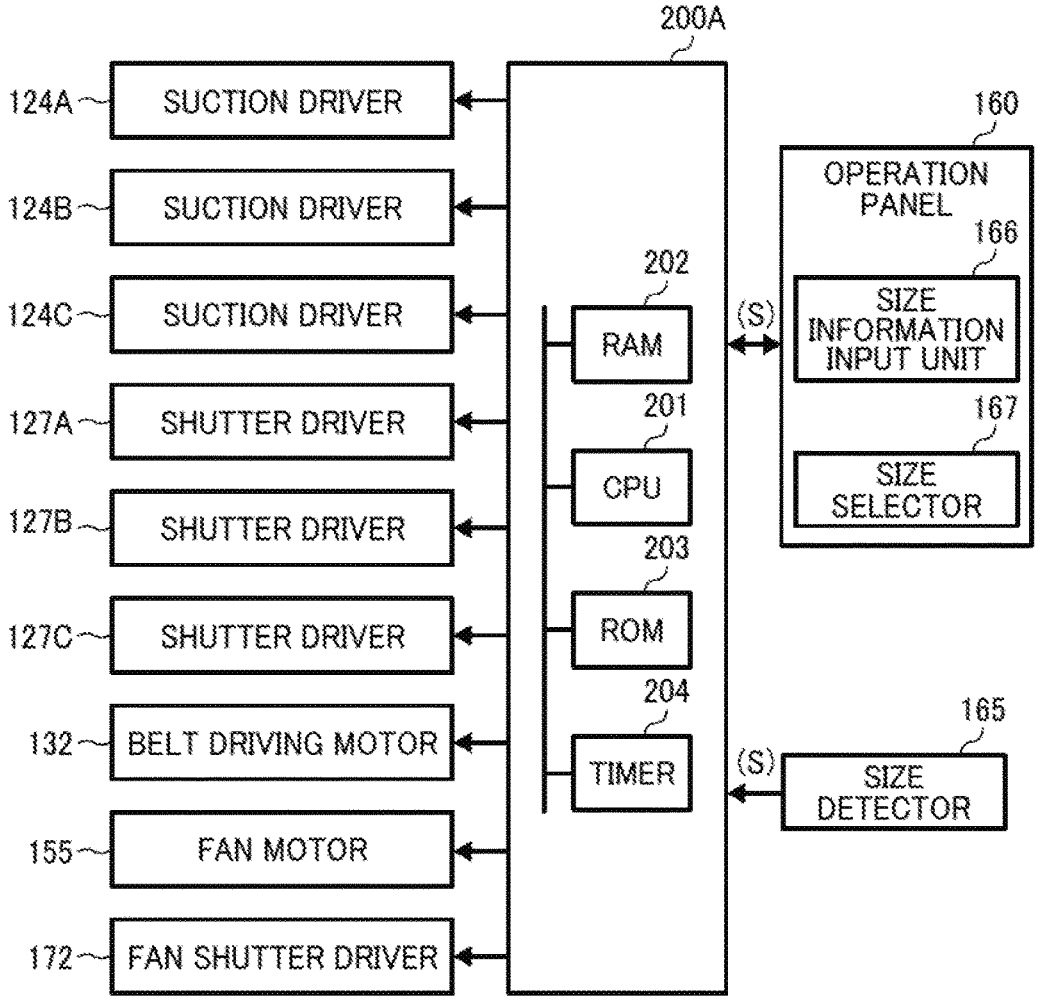
FIG. 12 is a block diagram illustrating a configuration of a control system of a medium-suction apparatus according to a fourth embodiment.

As illustrated in FIG. 12, at an input side of the controller 200, an operation panel 160 and a size detector 165 instead of the thickness detector 161 are connected to the controller 200 via signal line.

The size detector 165 has a sensor to detect the size of the medium 101. A size information input unit 166 and a size selector 167 are displayed on the operation panel 160 as switches. The size information input unit 166 is for inputting information of size S of the medium 101 to the controller 200. The size selector 167 is for selection of size S of the medium 101.

In the present embodiment, the information of the size S selected from the information of the size S detected by the size detector 165, the information of the size S input from the size information input unit 166, and the information of the size S selected by the size selector 167, may be used as the information of the size S of the medium 101. The present embodiment may include at least one of the size detector 165, the size information input unit 166, or the size selector 167, and does not necessarily include all of them.

An output side of the controller 200 is connected with the suction drivers 124A, 124B, and 124C, the shutter drivers 127A, 127B, and 127C, the belt driving motor 132, the fan motor 155, and fan shutter driver 172 via signal lines. The controller 200 operates to turn on and turn off the suction drivers 124A, 124B, and 124C, the shutter drivers 127A, 127B, and 127C, the belt driving motor 132, the fan motor 155, and the fan shutter driver 172 according to an operation timing stored in the ROM 203 of the controller 200A.

The ROM 203 of the controller 200 previously stores the predetermined size S1 for determining the size S. This predetermined size S1 may be changed arbitrarily. The ROM 203 of the controller 200 previously stores time Tc and Td as an interval of timing of starting the suction operation of the first suction unit 120C and the suction units 120A and 120B. The time Tc is set to be smaller than the time Td (Tc<Td).

Figure 13:
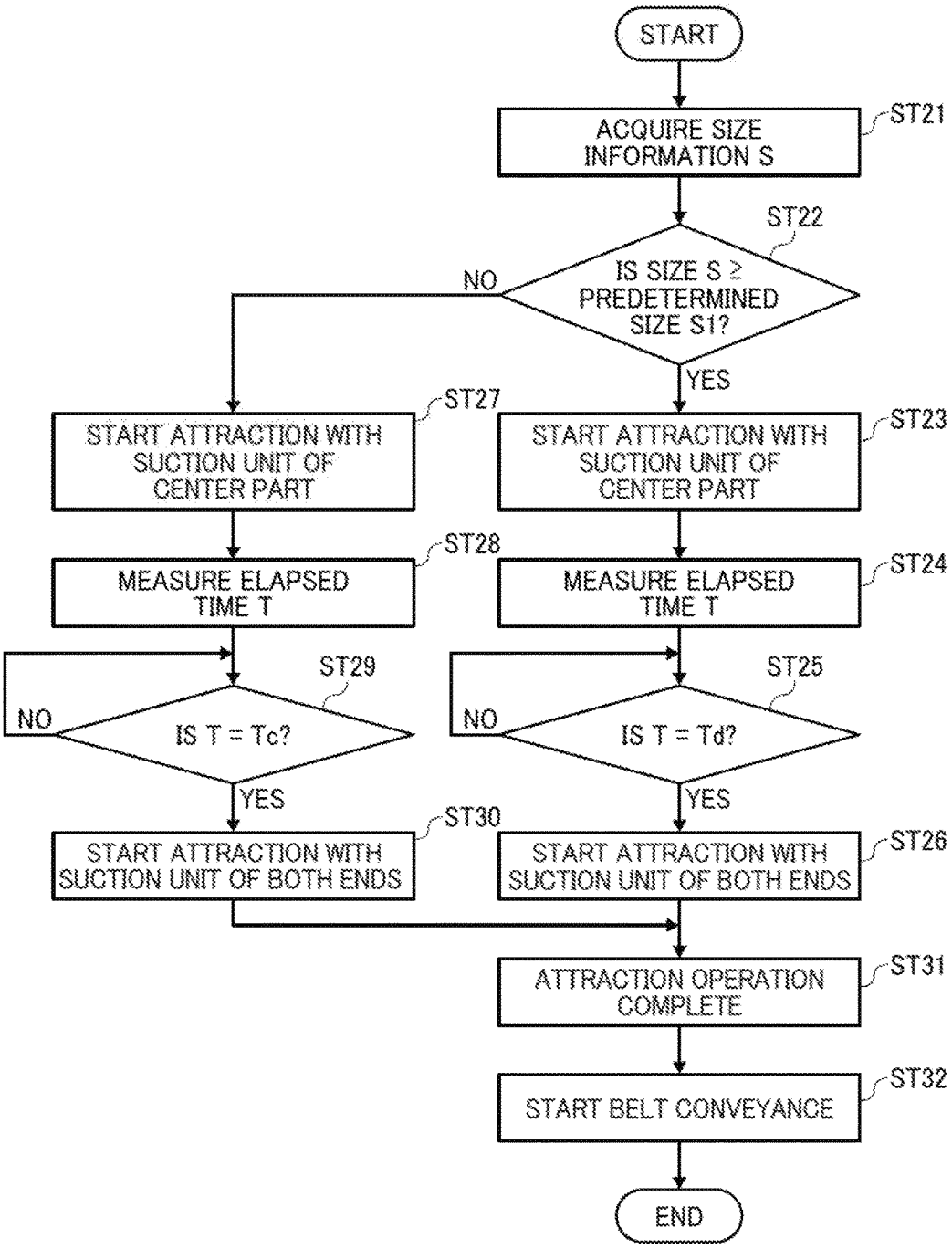
FIG. 13 is a flowchart of a suction operation of the medium-suction apparatus according to the fourth embodiment.

FIG. 13 is a flow chart of a control operation of the suction units 120A, 120B, and 120C of the controller 200A of the medium-suction apparatus 100 according to the fourth embodiment of the present disclosure. In the present embodiment, it is assumed that the suction units 120A, 120B, and 120C have been already in an operation mode.

The controller 200A acquires size S information of the medium 101 from the size detector 165, the size information input unit 166, or the size selector 167 in step ST21, and the process goes to step ST22.

The controller 200A compares the size S and the predetermined size S1 in step ST22 and determines whether the size S of the medium 101 is not less than the predetermined size S1. If the size S of the medium 101 is not less than the predetermined size S1 ("YES" in step ST22), the process goes to step ST23. In step ST23, the controller 200A starts attraction of the medium 101 with the suction unit 120C that faces to the center part 101*c* of the medium 101. In step ST23, the controller 200A operates the shutter driver 127C to drive the shutter 126C of the suction unit 120C to open the suction duct 122C to start attraction of the center part 101*c* of the medium 101.

The controller 200A measures the elapsed time T after the start of the operation of the shutter driver 127C with the timer 204 in step ST24. The process goes to step ST26 when the elapsed time T becomes the time Td in step ST25. The controller 200A operates the shutter drivers 127A and 127B to drive the shutters 126A and 126B to open the suction ducts 122A and 122B to start attraction of both ends 101*a* and 101*b* of the medium 101 with the suction units 120A and 120B in step ST26. Then, the process goes to step ST31.

If the size S of the medium 101 is less than the predetermined size S1 in step ST22 ("NO" in step ST22), the process goes to step ST27. In step ST27, the controller 200A starts attraction of the center part 101*c* of the medium 101 with the suction unit 120C. Then, the process goes to step ST28. In step ST27, the controller 200A operates the shutter driver 127C to drive the shutter 126C of the suction unit 120C to open the suction duct 122C to start attraction of the center part 101*c* of the medium 101.

The controller 200A measures the elapsed time T after the start of the operation of the shutter driver 127C with the timer 204 in step ST28. The process goes to step ST30 when the elapsed time T becomes the time Tc in step ST29. The controller 200A operates the shutter drivers 127A and 127B to drive the shutters 126A and 126B to open the suction ducts 122A and 122B to start attraction of both ends 101*a* and 101*b* of the medium 101 with the suction units 120A and 120B in step ST30. Then, the process goes to step ST31.

The controller 200A controls a difference of operation timing between the suction unit 120C and the suction units 120A and 120B when the size S of the medium 101 is not less than the predetermine size S1 to be greater than the difference of an operation timing between the suction unit 120C and the suction units 120A and 120B when the size S of the medium 101 is less than the predetermine size S1.

In the present embodiment, the time Tc and Td is set to 0 [msec]≤Tc<Td. If Tc is set to zero minute, the controller 200A simultaneously opens the suction ducts 122A, 122B, and 122C by simultaneously driving all of the shutter drivers 127A, 127B, and 127C of the suction units 120A, 120B, and 120C.

In other words, the controller 200A controls the difference of the operation timing between the suction unit 120C and the suction units 120A and 120B when the size S of the medium 101 is less than the predetermine size S1 to be smaller than the difference of the operation timing between the suction unit 120C and the suction units 120A and 120B when the size S of the medium 101 is not less than a predetermine size S1.

In step ST31, the controller 200A determine an completion of the suction operation of the medium 101 to the suction face 131A of the conveyance belt 131 based on the elapsed time from the start of the operation of a sensor such as a thickness detector 161 or the elapsed time from the start of the operation of the shutters 126A and 126B, for example. Then, the controller 200 operates the belt driving motor 132 to start conveyance of the medium 101 with the conveyance belt 131 and completes the suction operation.

In this way, the controller 200A acquires the size S of the medium 101 and changes the operation timing between the suction unit 120C (shutter 126C) and the suction units 120A and 120B (shutters 126A and 126B' based on the acquired information of size S, and thereby perform an appropriate suction operation according to the size S of the medium 101. Thus, if size of the medium 101 is large such as size not less than B2 size in JIS (Japanese Industrial Standards) standard, for example, flexing of the medium 101 in the width direction W occurs easily.

Then, the controller 200A increase the difference of an operation timing between the suction unit 120C, which is first to start operation, and the suction units 120A and 120B, which are second to start operation. Thus, the controller 200A provides an interval between two operation timing for a degree to suppress the occurrence of the flexing. The medium-suction apparatus 100 can thereby reduce the occurrence of the crease caused by the flexing of the medium 101.

Thus, the controller 200A adjusts time interval between starts of the suction operations of the suction unit 120C (first suction unit), the suction unit 120A (second suction unit), and the suction unit 120B (third suction unit) according to the size of the medium 101. Further, the controller 200 controls the time interval of when the size S of the medium 101 is not less than a predetermined value S1 to be greater than the interval of when the size S of the medium is less than the predetermined value S1.

If size of the medium 101 is small such as less than B2 size in JIS standard (for example, not greater than A3 size in JIS standard) flexing of the medium 101 in the width direction W is not easily occur. Then, the controller 200A controls the intervals of when the size S of the medium 101 is less than a predetermined value S1 to be smaller than the intervals of when the size S of the medium 101 is not less than the predetermined value S1.

Thus, the controller 200 adjusts time intervals between starts of the suction operations of the suction units 120A, 120B, and 120C according to the size S of the medium, and the controller 200 lengthens the time intervals of when the size S of the medium is not less than a predetermine value compared to when the size of the medium is less than the predetermine value.

The controller 200 may simultaneously start operate the plurality of the suction units 120A, 120B, and 120C in certain circumstances. By reducing the operation time, the medium-suction apparatus 100 of the present embodiment can quickly float and attract the medium 101 to the suction face 131A of the conveyance belt 131 to reduce the operation time of the suction unit 120 in case of using small-sized medium 101.

Thus, it is possible to make the duration of the suction operation of the smaller-sized medium 101 to be smaller than the duration of the suction operation of the larger-sized medium 101. The duration of the suction operation is time from the start of the suction operation to the time, in which the medium 101 is attracted to the suction face 131A of the conveyance belt 131 and is start to be conveyed by the conveyance belt 131. Thereby, this embodiment is advantageous in terms of productivity.

Here, the B2 size in JIS standard, which is described as the predetermined size S1 of the medium 101, is one example of the size. The predetermined size is not limited to this size and can be any other size.

When the size S of the medium 101 is not less than the predetermined size S1, the controller 200A controls the intervals of the operation timing among a plurality of the suction units 120A, 120B, and 120C C to be greater than the intervals when the size S of the medium 101 is less than the predetermined size S1. Thus, the controller 200A controls the intervals of when the size S of the medium 101 is less than a predetermined value S1 to be greater than the intervals of when the size S of the medium 101 is not less than the predetermined value S1.

The medium-suction apparatus 100 can thereby reduce the occurrence of the crease caused by the flexing of the medium 101.

In the third and fourth embodiments of the present disclosure, the controller 200 or 200A controls the operation timing of the plurality of the suction units 120A, 120B, and 120C according to the thickness X or size S of the medium 101, respectively. However, parameters used for controlling the operation timing are not limited to thickness or size of the media, and thus, for example, the parameters may be the material of the media (for example, paper sheet, or resin made sheet material or board member such as prepreg).

In this case, the controller 200A controls operation timing of the plurality of suction units 120A, 120B, and 120C according to the type (the predetermined characteristic) of medium 101 using controller 200. For example, the controller 200A simultaneously starts the operation of the plurality of the suction units 120A, 120B, and 120C when the medium 101 is made of material having high rigidity and is not easy to flex in the width direction W, such as prepreg. The controller 200A may provide a difference of timing of starting the suction operation among the plurality of the suction units 120A, 120B, and 120C when the medium 101 is made of material having high rigidity, but set the time difference smaller than that of paper sheet.

When the paper sheet is suctioned by the medium-suction apparatus 100 as the medium 101, the controller 200A increase the interval of the operation timing between the suction unit 120C, which is first to start operation, and the suction units 120A and 120B, which are second to start operation, to be greater than that of when prepreg is suctioned by the medium-suction apparatus 100. Thus, the medium-suction apparatus 100 can quickly attract and convey the paper sheet and also can attract and convey the paper sheet without causing the crease.

Figure 14:
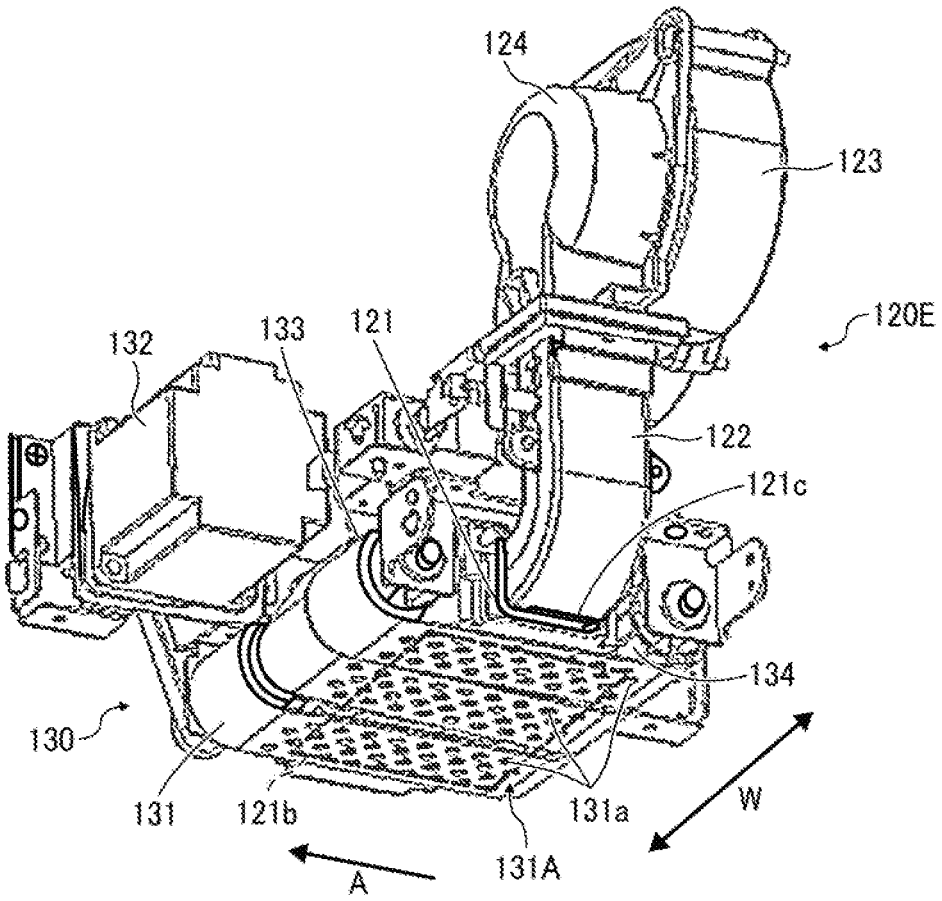
FIG. 14 is a perspective view of the medium-suction apparatus.
Figure 15:
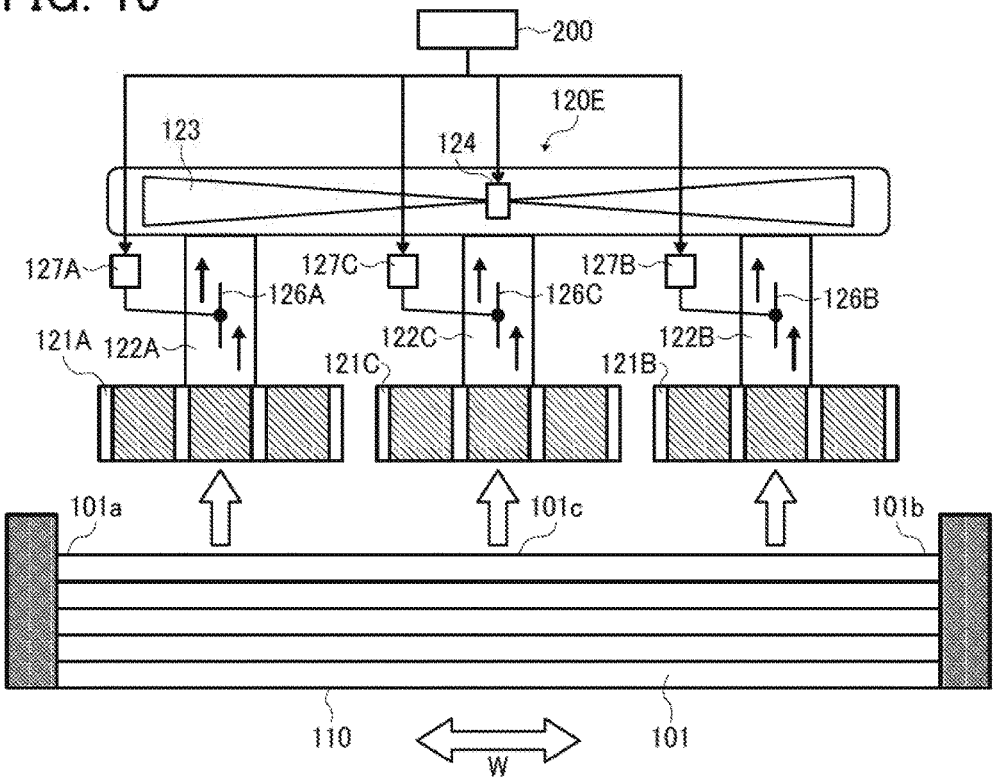
FIG. 15 is a schematic cross-sectional view of a medium-suction apparatus according to still another embodiment.

FIG. 14 is a perspective view of the medium-suction apparatus 100 according to still another embodiment. FIG. 15 is a schematic cross-sectional view of a medium-suction apparatus 100 illustrated in FIG. 14.

In the first embodiment to the fourth embodiment, the plurality of suction units 120A, 120B, and 120C have the suction blades 123A, 123B, and 123C and the suction drivers 124A, 124B, and 124C, respectively. However, the present disclosure is not limited to the above-described configuration. For example, as illustrated in FIGS. 14 and 15, a suction unit 120B may have a configuration including a single suction blade 123 and a single suction driver 124 that is connected to each of the suction ducts 122A, 122B and 122C as negative pressure generator.

Fifth Embodiment

Figure 16:
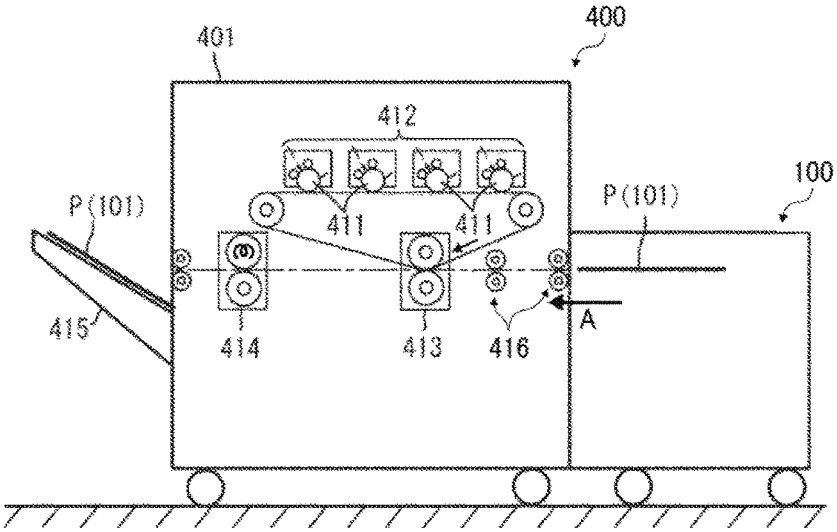
FIG. 16 is a schematic cross-sectional view of an image forming system.

FIG. 16 is a schematic cross-sectional view of an image forming system.

As illustrated in FIG. 16, the present embodiment applies the medium-suction apparatus 100 of one of the first to fourth embodiments to an image forming system 400. The image forming system 400 includes an image forming part 401 and a medium-suction apparatus 100, and a plurality of roller pairs 416. The image forming part 401 forms an image on the medium 101 such as sheet P. The medium-suction apparatus 100 suctions and feeds the medium 101 such as sheet P to the image forming part 401. The roller pairs 416 convey the medium 101 attracted by the medium-suction apparatus 100 to the image forming system 400.

A well-known electrographic method type of image forming part is illustrated in FIG. 16 as the image forming part 401. The image forming part 401 includes a plurality of process cartridge units 412, an image bearer 411, a transfer 413, a fixing part 414, and a discharge tray 415. Each of the process cartridge units 412 includes a drum-shaped image bearer 411. The image forming part 401 forms an electrostatic latent image on the image bearer 411 of the process cartridge units 412.

The image forming part 401 develops toner image on the image bearer 411 by adhering toner as developer on the electrostatic latent image of the image bearer 411. The transfer 413 transfers the developed toner image on the sheet P. The fixing part 414 fixes the toner image on the sheet P. Then, the sheet P is discharged to and stacked on the discharge tray 415.

As the image forming part 401, an inkjet type may be used instead of an electrographic method type. The inkjet type discharges ink to the medium 101 such as sheet P from an inkjet head to form an image on the medium 101.

In all types of the image forming part 401, the medium-suction apparatus 100 suctions and conveys the topmost sheet P stacked on the stacker 110 with the suction units 120A, 120B, and 120C, thereby securing good separability of the sheet P. Thus, the medium-suction apparatus 100 can reduce paper jam occurred by multi-feed of the sheet P and double feeding of the sheet P. Further, the medium-suction apparatus 100 can reduce separation time of the sheet so that it is possible to reduce the print time and to manage high-speed feeding of the medium 101. Therefore, the medium-suction apparatus 100 can construct the image forming system 400 having high productivity by enabling to print medium 101 of larger size.

Sixth Embodiment

Figure 17A:
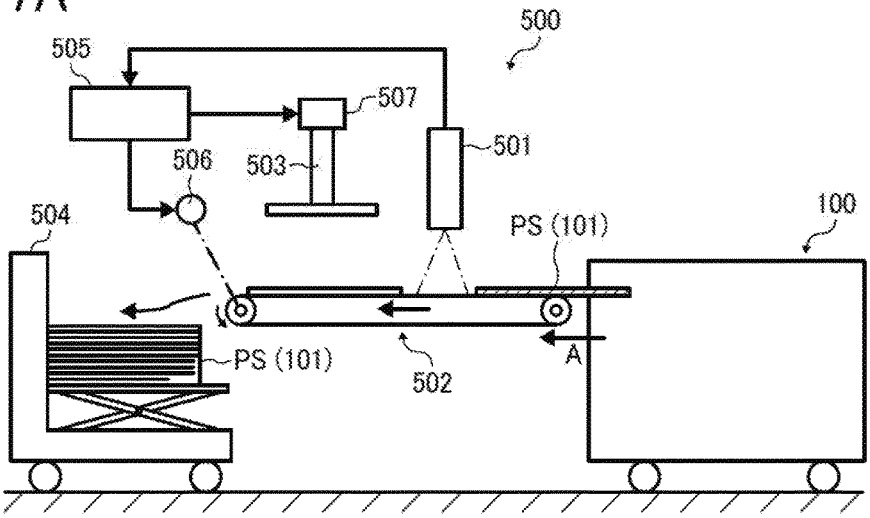
FIGS. 17A to 17C are schematic cross-sectional views of a medium inspection system.
Figure 17B:
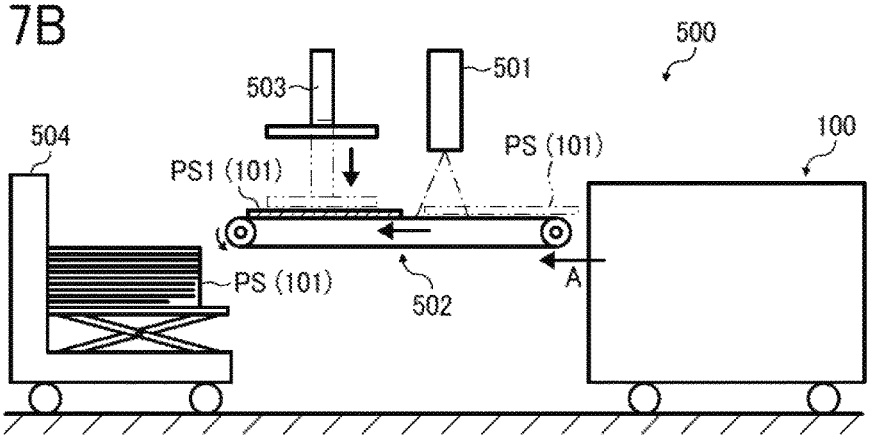
Figure 17C:
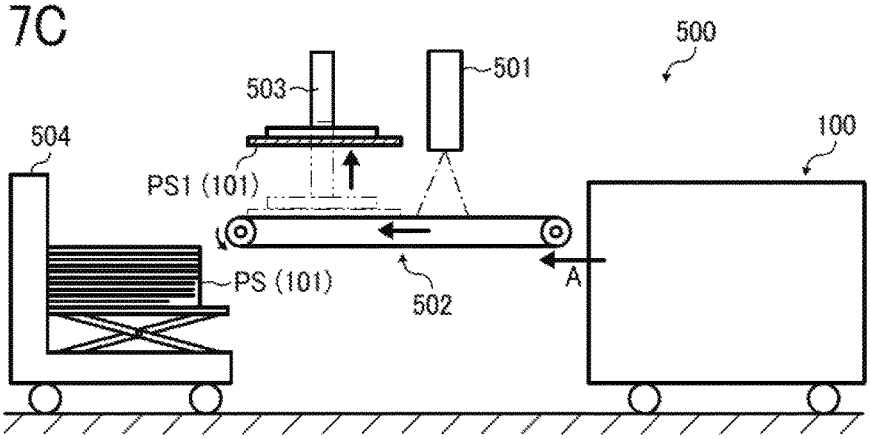

As illustrated in FIGS. 17A to 17C, the present embodiment applies the medium-suction apparatus 100 of one of the first to fourth embodiments to a medium inspection system 500. The medium inspection system 500 includes an inspection apparatus 501, a controller 505, and a medium-suction apparatus 100. The inspection apparatus 501 acts as an inspection part to inspect medium 101 such as prepreg sheet PS. The medium-suction apparatus 100 suctions and conveys the prepreg sheet PS to the inspection apparatus 501.

In the above-described embodiments, the arrangement of the suction units 120A, 120B, and 120C is not limited alignment in the width direction W as illustrated in FIG. 2, and may be changed accordingly.

Figure 18A:
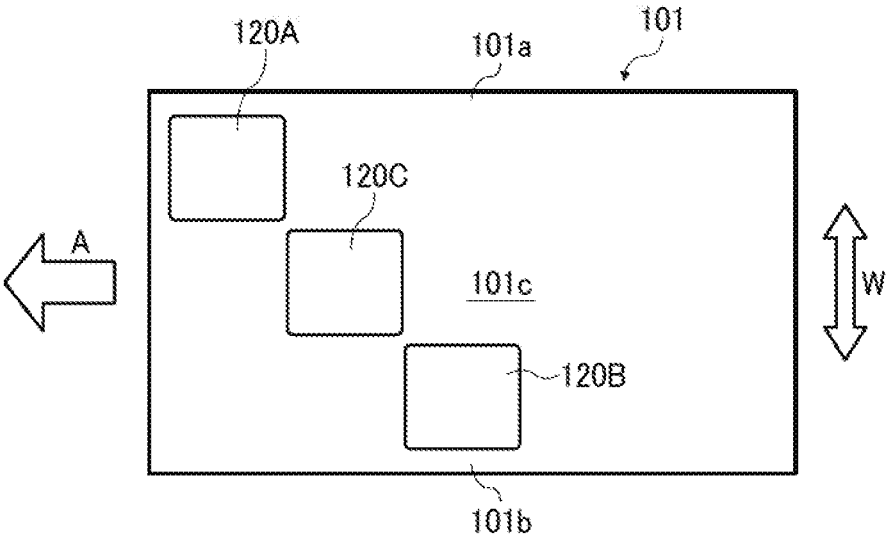
FIGS. 18A and 18B are schematic plan views of the suction units.
Figure 18B:
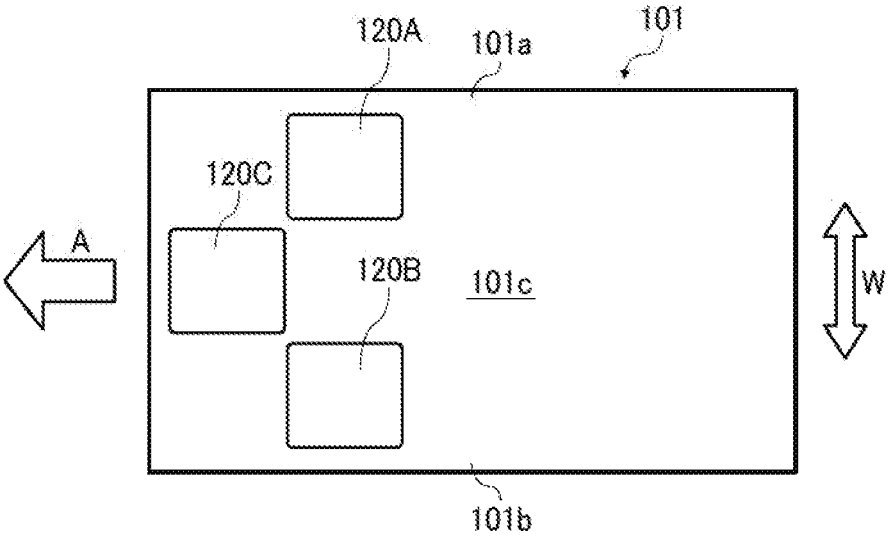

FIG. 18 is a schematic plan view of an example of the suction units 120A, 120B and 120C. As illustrated in FIGS. 18A and 18B, the suction chambers 121A, 121B, and 121C of the suction units 120A, 120B, and 120C, respectively, may be arranged in obliquely manner or in staggered manner in the conveyance direction A.

Even in these cases, the suction units 120A, 120B, and 120C are disposed in the order of the suction units 120A, 120C, and 120B in the width direction W when the medium-suction apparatus 100 is viewed from downstream side in the conveyance direction A (viewed from viewpoint of FIGS. 6A to 6D). Therefore, the configurations as illustrated in FIGS. 18A and 18B can attain similar effects as those attained in the above-described embodiments. For example, the configurations as illustrated in FIGS. 18A and 18B may be applied to the suction units described in FIGS. 6A to 6D, FIGS. 8A to 8D. FIGS. 9A and 9C, and FIGS. 10 to 16.

The medium inspection system 500 includes a sheet conveyer 502 to convey the prepreg sheet PS. The sheet conveyer 502 is disposed under the inspection apparatus 501. The sheet conveyer 502 constitutes a convey apparatus to convey the prepreg sheet PS attracted by the medium-suction apparatus 100 to the inspection apparatus 501. The medium inspection system 500 includes a sheet conveyer 502 to convey the prepreg sheet PS under the inspection apparatus 501.

The inspection apparatus 501 detects damage on a surface of the prepreg sheet PS or size of the damage thereof by line scanning the surface of the prepreg sheet PS and detecting the damage from image information obtained by the line scanning. The inspection apparatus 501 detects the surface condition of the prepreg sheet while conveying the prepreg sheet PS with the sheet conveyer 502.

The medium inspection system 500 includes an attraction unit 503. The attraction unit 503 is disposed downstream side of the inspection apparatus 501 in the conveyance direction of the prepreg sheet PS. Further, the attraction unit 503 is disposed above the sheet conveyer 502.

As illustrated in FIGS. 17A to 17C, the attraction unit 503 suctions and attracts the prepreg sheet PS, on which a surface defection is detected. The medium inspection system 500 includes a stacker apparatus 504. The stacker apparatus 504 is disposed downstream side of the sheet conveyer 502 in the conveyance direction of the prepreg sheet PS. The stacker apparatus 504 stacks the prepreg sheet PS that is not attracted by the attraction unit 503 and does not have surface defection among the prepreg sheet PS conveyed by the sheet conveyer 502.

Here, prepreg is a reinforced plastic molding material that is manufactured by uniformly impregnating fibrous reinforced material with thermosetting resin and heating or drying the impregnated fibrous reinforced material to make it half-hardened status. As an example of the fibrous reinforced material, there is glass cloth, carbon fibers, etc. As an example of the thermosetting resin, there is epoxy resin mixed with additive such as hardener and adhesive. The prepreg mainly indicates sheet-like material formed with carbon fiber impregnated with resin.

As illustrated in FIG. 17A, the controller 505 is connected with the inspection apparatus 501, a drive motor 506 as a power source of the sheet conveyor 502, and an suction driver source 507 of the attraction unit 503 via signal lines. The controller 505 has a function of determining whether the prepreg sheet PS is defective or acceptable according to the image information transmitted from the inspection apparatus 501.

The controller 505 operates the suction driver source 507 of the attraction unit 503 to apply suction force on the sheet conveyer 502 when the prepreg sheet PS is determined to be defective (PS1) by the inspection apparatus 501. Thus, the prepreg sheet PS1 that is determined to be defective is removed by the attraction unit 503 from the sheet conveyer 502.

Thus, the medium-suction apparatus 100 attracts the topmost prepreg sheet PS from stacked prepreg sheets PS using the suction units 120A, 120B, and 120C to secure separability of the prepreg sheet PS, and thereby can reduce paper jam occurred by multi-feed of the prepreg sheet PS and double feeding of the prepreg sheet PS. Further, the medium-suction apparatus 100 can reduce inspection time of the prepreg sheet PS so that it is possible to reduce the separation time and to manage high-speed feeding of the medium 101. Therefore, the medium-suction apparatus 100 can construct the medium inspection system 500 having high productivity.

Some prepreg sheets PS are thin such as having thickness from 0.02 mm to 0.2 mm. Thus, there is large possibility of occurrence of flexing and crease on the prepreg sheet PS. Especially, the occurrence of flexing becomes remarkable when the size of sheet (area) of the prepreg sheet PS is large because of increase in margin for flexing.

The present disclosure is not limited to the details of the example embodiments described above, and various modifications and improvements are possible.

The medium 101 according to the present disclosure is not limited to the sheet P and resinous sheet material such as the prepreg sheet PS, but may be a recording sheet, a film, or fabrics, for example. Specifically, the medium 101 may be any sheet-shaped attractable medium such as a sheet, a recording medium, an overhead projector (OHP) sheet, a prepreg and copper foils, for example.

Further, in FIG. 2, the plurality of the suction units 120A, 120B, and 120C are aligned in line in the width direction W. However, the same effect of the present embodiment may be obtained by arranging the suction units 120A, 120B, and 120C as illustrated in FIGS. 18A and 18B. In FIG. 18A, the suction unit 120C is shifted from the suction unit 120A, and the suction unit 120B is shifted from the suction unit 120A and the suction unit 120C in the conveyance direction A. In FIG. 18B, the suction unit 120C is shifted from the suction units 120A and 120B in the conveyance direction A, and the suction units 120A and 120B are aligned in line in the conveyance direction A.

In other words, at least one of the suction unit 120C (first suction unit), the suction unit 120A (second suction unit), and the suction unit 120B (third suction unit) is offset from the other suction units of the suction unit 120C (first suction unit), the suction unit 120A (second suction unit), and the suction unit 120B (third suction unit) in the conveyance direction A.

In FIGS. 18A and 18B, the suction units 120A and 120B are disposed in both ends in the width direction W, and the suction unit 120C is disposed between the suction units 120A and 120B in the width direction W. In FIGS. 18A and 18B, the suction units 120A, 120B, and 120C may be operated in the operation timing as described above in FIGS. 6A to 6D and FIGS. 8A to 8D.

In other words, at least one of the suction unit 120C (the first suction unit), the suction unit 120A (second suction unit), and the suction unit 120B (third suction unit) may be disposed to be shifted from other suction units in the conveyance direction A.

Further, also in FIGS. 18A and 18B, the suction unit 120C (first suction unit), the suction unit 120A (second suction unit), and the suction unit 120B (third suction unit) are disposed in a width direction W.

Further, the meaning of "conveyance" is not limited to move the medium 101 by the conveyance belt 131, but including simply suctioning the medium 101 by the suction unit 120 to move the medium 101.

Additionally, effects of the embodiments mentioned above are examples of preferable effects, and effects attained by various aspects of this specification are not limited thereto.

An image information system such as that disclosed in U.S. Pat. No. 8,119,071 may be adopted as the image forming system 400. Further, as an image forming system, not only the inkjet type but also the electrophotography type, may be used.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A medium-suction apparatus comprising:

a conveyer to convey a medium in a predetermined conveyance direction;

a first suction unit to perform a first suction operation on the medium to attract the medium to the conveyer;

a second suction unit to perform a second suction operation on the medium to attract the medium to the conveyer, the second suction unit being disposed next to the first suction unit in a width direction perpendicular to the conveyance direction; and a controller to control the first suction unit to start to perform the first suction operation on the medium at a first timing and to control the second suction unit to start to perform the second suction operation on the medium at a second timing, which is a predetermined amount of time, registered by the controller, after the first timing at which the first suction unit starts performing the first suction operation on the medium.

2. The medium-suction apparatus according to claim 1, further comprising a third suction unit to perform a suction operation on the medium to attract the medium to the conveyer, wherein the third suction unit is disposed on an opposite side of the first suction unit with respect to the second suction unit in the width direction, and wherein the third suction unit starts the suction operation after the second suction unit starts the suction operation.

3. The medium-suction apparatus according to claim 1, further comprising a third suction unit to perform a suction operation on the medium to attract the medium to the conveyer, wherein the third suction unit is disposed on an opposite side of the second suction unit with respect to the first suction unit in the width direction, and wherein the third suction unit starts the suction operation after the second suction unit starts the suction operation.

4. The medium-suction apparatus according to claim 1, further comprising a third suction unit to perform a third suction operation on the medium to attract the medium to the conveyer, wherein the third suction unit is disposed on an opposite side of the second suction unit with respect to the first suction unit in the width direction, and wherein the second suction unit and the third suction unit simultaneously start the second and third suction operations, respectively, after the first suction unit starts the first suction operation.

5. The medium-suction apparatus according to claim 4, wherein the controller controls, based on a predetermined characteristic of the medium, the first timing of starting the first suction operation of the first suction unit, the second timing of starting the second suction operation of the second suction unit, and a third timing of starting the third suction operation of the third suction unit, the predetermined amount of time being based on the predetermined characteristic of the medium.

6. The medium-suction apparatus according to claim 5, wherein:

the predetermined characteristic of the medium is basis weight of the medium; and the controller adjusts time intervals between starts of the suction operations of the first suction unit, the second suction unit, and the third suction unit according to the basis weight of the medium, wherein the controller lengthens the time intervals when the basis weight of the medium is less than a predetermined value compared to when the basis weight of the medium is not less than the predetermined value.

7. The medium-suction apparatus according to claim 5, wherein:

the predetermined characteristic of the medium is size of the medium; and the controller adjusts time intervals between starts of the suction operations of the first suction unit, the second suction unit, and the third suction unit according to the size of the medium, wherein the controller lengthens the time intervals when the size of the medium is not less than a predetermined value compared to when the size of the medium is less than the predetermined value.

8. The medium-suction apparatus according to claim 4, wherein each of the first suction unit, the second suction unit, and the third suction unit comprises:

a chamber through which air is communicated;

a negative pressure generating device connected to the chamber to generate negative pressure in the chamber; and a control valve to control the negative pressure in the chamber.

9. The medium-suction apparatus according to claim 4, wherein at least one of the first suction unit, the second suction unit, and the third suction unit is offset from the other suction units of the first suction unit, the second suction unit, and the third suction unit in the conveyance direction.

10. The medium-suction apparatus according to claim 1, wherein the controller controls, based on a predetermined characteristic of the medium, the first timing of starting the first suction operation of the first suction unit and the second timing of starting the second suction operation of the second suction unit, the predetermined amount of time being based on the predetermined characteristic of the medium.

11. The medium-suction apparatus according to claim 10, wherein:

the predetermined characteristic of the medium is basis weight of the medium; and the controller adjusts a time interval between starts of the suction operations of the first suction unit and the second suction unit according to the basis weight of the medium;

wherein the controller lengthens the time interval when the basis weight of the medium is less than a predetermined value compared to when the basis weight of the medium is not less than the predetermined value.

12. The medium-suction apparatus according to claim 10, wherein:

the predetermined characteristic of the medium is size of the medium; and the controller adjusts a time interval between starts of the suction operations of the first suction unit and the second suction unit according to the size of the medium, wherein the controller lengthens the time interval when the size of the medium is not less than a predetermined value compared to when the size of the medium is less than the predetermined value.

13. The medium-suction apparatus according to claim 1, wherein each of the first suction unit and the second suction unit comprises:

a chamber through which air is communicated;

a negative pressure generating device connected to the chamber to generate negative pressure in the chamber; and a control valve to control the negative pressure in the chamber.

14. The medium-suction apparatus according to claim 1, wherein the predetermined amount of time corresponds to an amount of time until a center portion or end portion, in the width direction, of the medium is attracted to the conveyer by the first suction unit.

15. The medium-suction apparatus according to claim 1, further comprising a timer to measure an elapsed time from the start of the first suction operation, wherein the controller determines that the predetermined amount of time has elapsed by comparing the elapsed time measured by the timer with the predetermined amount of time registered by the controller.

16. The medium-suction apparatus according to claim 1, further comprising a third suction unit to perform a third suction operation on the medium to attract the medium to the conveyer, wherein at least one of the first, second and third suction units is offset in the conveyance direction from one or more others of the first, second and third suction units and is not adjacent to the other suction units of the first suction unit, the second suction unit, and the third suction unit in the width direction.

17. A medium-suction apparatus comprising:

a conveyer to convey a medium in a predetermined conveyance direction;

a first suction unit to perform a suction operation on the medium to attract the medium to the conveyer;

a second suction unit to perform a suction operation on the medium to attract the medium to the conveyer, the second suction unit being disposed next to the first suction unit in a width direction perpendicular to the conveyance direction; and a controller to control a timing of starting the suction operation of each of the first suction unit and the second suction unit according to a predetermined characteristic of medium, wherein the second suction unit starts the suction operation after the first suction unit starts the suction operation, the predetermined characteristic of the medium is thickness of the medium, the controller adjusts a time interval between starts of the suction operations of the first suction unit and the second suction unit according to the thickness of the medium, and the controller lengthens the time interval when the thickness of the medium is less than a predetermined value compared to when the thickness of the medium is not less than the predetermined value.

18. A medium-suction apparatus comprising:

a conveyer to convey a medium in a predetermined conveyance direction;

a first suction unit to perform a suction operation on the medium to attract the medium to the conveyer;

a second suction unit to perform a suction operation on the medium to attract the medium to the conveyer, the second suction unit being disposed next to the first suction unit in a width direction perpendicular to the conveyance direction;

a third suction unit to perform a suction operation on the medium to attract the medium to the conveyer; and a controller to control a timing of starting the suction operation of each of the first suction unit, the second suction unit, and the third suction unit according to a predetermined characteristic of medium, wherein the second suction unit starts the suction operation after the first suction unit starts the suction operation, the third suction unit is disposed on an opposite side of the second suction unit with respect to the first suction unit in the width direction, the second suction unit and the third suction unit simultaneously start the suction operations after the first suction unit starts the suction operation, the predetermined characteristic of the medium is thickness of the medium, the controller controls time intervals between starts of the suction operations of the first suction unit, the second suction unit, and the third suction unit according to the thickness of the medium, the controller lengthens the time intervals when the thickness of the medium is less than a predetermined value compared to when the thickness of the medium is not less than the predetermined value.

19. An image forming system, comprising:

the medium-suction apparatus according to claim 1; and an image forming unit to form an image on the medium conveyed by the conveyor of the medium-suction apparatus.

* * * * *